US009010036B2

(12) United States Patent
McDonald et al.

(10) Patent No.: US 9,010,036 B2
(45) Date of Patent: Apr. 21, 2015

(54) MINE HAVEN

(75) Inventors: Rex McDonald, London, KY (US); Hanners Gevedon, Mt. Vernon, KY (US)

(73) Assignee: Sumter Corporation, London, KY (US)

( * ) Notice: Subject to any disclaimer, the term of this patent is extended or adjusted under 35 U.S.C. 154(b) by 809 days.

(21) Appl. No.: 12/635,379

(22) Filed: Dec. 10, 2009

(65) Prior Publication Data

US 2010/0175334 A1 Jul. 15, 2010

Related U.S. Application Data

(60) Provisional application No. 61/201,569, filed on Dec. 12, 2008.

(51) Int. Cl.
*E04H 9/00* (2006.01)
*E21F 11/00* (2006.01)

(52) U.S. Cl.
CPC ..... *E21F 11/00* (2013.01)

(58) Field of Classification Search
USPC ..... 52/79.9, 169.6, 2.17, 2.22, 2.23, 79.12, 52/220.1; 454/169, 170, 187; 135/137, 135/156, 900; 299/12, 95
See application file for complete search history.

(56) References Cited

U.S. PATENT DOCUMENTS 6,006,944 A * 12/1999 Machledt ..... 220/567.1
2002/0083653 A1* 7/2002 Hilbert
2007/0199244 A1* 8/2007 Kennedy et al. ..... 49/70

* cited by examiner

*Primary Examiner* — William Gilbert
(74) *Attorney, Agent, or Firm* — Stockwell & Smedley, PSC

(57) ABSTRACT

Systems and methods are provided for a modular shelter that is suited for use as a safety chamber in an underground working environment. The shelter includes at least two wall units connected along a substantially sealed seam, a base unit that extends substantially throughout a floor plan of the shelter, and a roll cage that surrounds an outer extent of the shelter above the floor plan. The shelter may be configured to maintain a pressurized state in a closed condition. Each of the at least two wall units may share a substantially common shape and substantially common dimension, and may form a part of a wall, ceiling, and floor of the shelter. The shelter can also include various atmospheric control, circulation, and purge systems, and exterior and soft seal doors to assist in maintaining a livable atmosphere in the safety chamber.

40 Claims, 23 Drawing Sheets

100

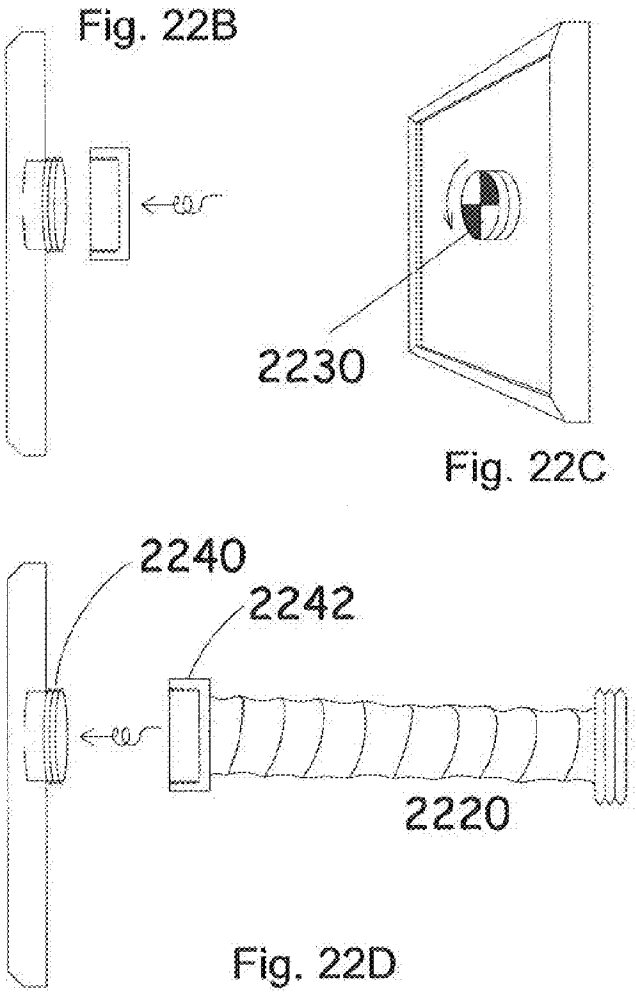
Fig. 22B
Fig. 22C
Fig. 22D
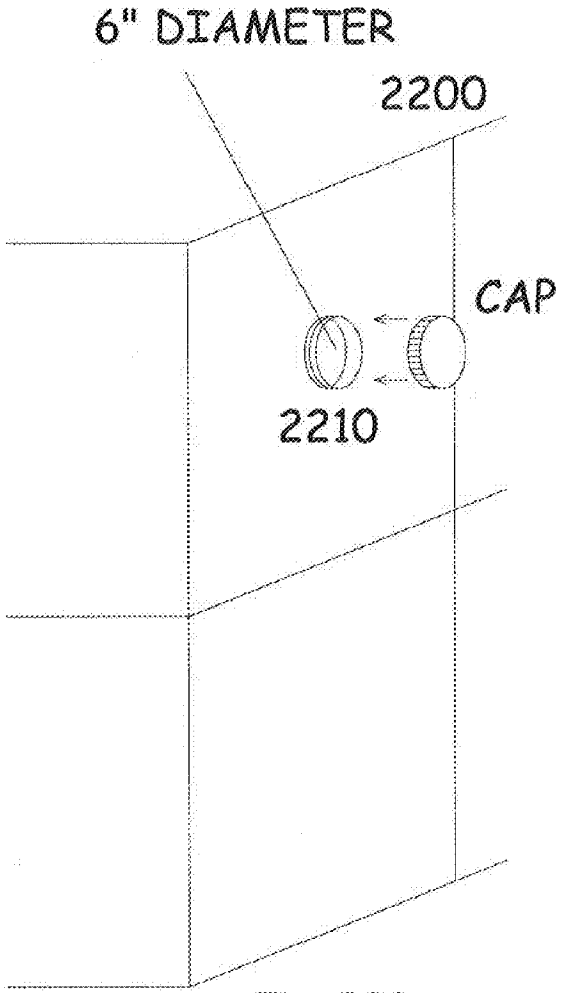
Fig. 22A

MINE HAVEN

CROSS-REFERENCES TO RELATED APPLICATIONS

This application claims priority to U.S. Provisional Application Ser. No. 61/201,569, filed Dec. 12, 2008, the contents of which are incorporated by reference herein in their entirety.

BACKGROUND OF THE INVENTION

Underground work, including underground mining, has been a historically dangerous, but critical, commercial activity. For example, the hazards involved in underground mining include suffocation, gas poisoning, roof collapse and gas explosions. Nonetheless, underground mining continues to account for approximately 60% of world coal production and other important resources. Although there have been significant improvement in underground mining safety, underground mining accounts for thousands of fatalities per year in foreign countries, and thousands of injuries and dozens of fatalities in the United States.

Of particular concern is the ability to sustain the lives of underground workers for a period of time if they become trapped underground or if the atmosphere of the underground atmosphere becomes dangerous. However, current safety devices have proven to be of limited value in sustaining the lives of groups of underground workers for the time necessary for rescue operations due to a number of factors including logistics, accessibility, protection and sustainability. Accordingly there is a continuing need for improved safety in the area of underground mining, in the United States and abroad.

BRIEF SUMMARY OF THE INVENTION

Aspects of the present disclosure are directed to systems and methods related to modular shelters including features that may find applicability in the field of underground safety and life support. Embodiments include an underground safety chamber of modular construction that may function as a containment device when placed in an underground area, where individuals are involved in activities such as coal mining, salt mining, or underground construction processes. The underground safety chamber may include features that allow individuals to enter and exit safely in the event of an accident such as, for example, atmospheric contamination, a roof fall or blockage of a shaft. Individuals may enter the safety chamber and have necessities such as food, water, air, and shelter for a period of time, such as, for example, several days. Embodiments may include an underground safety chamber including compressed breathable air, methodologies for $CO_2$ removal, particularized safety features, and monitoring systems, which allow for the sustainment of life during the period of time, for example, a four day period in which rescue work could be implemented.

Embodiments of the present subject matter include a modular shelter with a plurality of wall units. As used herein, the term "wall units" should be understood as including parts that can be assembled to form walls, ceilings, and floors of modular shelters described herein, and the like. The wall units may be connected along substantially sealed seams or made from a solid piece, laminate or composite. Embodiments may also include each of the plurality of wall units sharing a substantially common shape and substantially common dimensions. The plurality of wall units may be included in a wall, ceiling and/or floor of the shelter. Embodiments may include the wall units being connected, in part, by interior brackets. Seams between the wall units may also include a sealant that may assist in forming seals along edges and corners of connected wall units.

Embodiments of the modular shelter may include a base unit that extends substantially throughout a floor plan of the shelter. The base unit may be located underneath a floor of the shelter and may include a plurality of modular base pieces. Each of the modular base pieces may share a substantially common shape and substantially common dimensions. The base unit may also include edge pieces or other pieces that are shaped differently than the plurality of base pieces.

Embodiments of the modular shelter may also include a roll cage that surrounds an outer extent of the shelter above the floor plan. The roll cage may be attached to the base unit and/or walls, ceiling and/or floor of the shelter. The roll cage may be made up of round, square or other shaped sections either solid or hollow. Embodiments of the shelter may include configurations that allow the shelter to be lifted by a boom point on the roll cage, and/or dragged and/or pushed along an exterior surface by a boom point and/or a hard point on the base unit.

Embodiments may also include the shelter being configured to maintain a pressurized state in a closed condition. For example, the shelter may be configured to selectively withstand a pressure differential in a range of approximately ±15 PSI between an interior of the shelter and an exterior of the shelter. In embodiments, the shelter may be configured to withstand a greater exterior pressure differential than an interior pressure differential. For example, the shelter may withstand an exterior pressure differential of approximately +15 PSI, or more, and allow venting of an interior pressure of approximately +1 PSI. Embodiments of the shelter may also include an atmospheric venting and/or purge system, and a control system that operates the atmospheric venting/purge system to selectively force an atmospheric gas from within the shelter to an outside of the shelter. The atmospheric venting/purge system may include one or more one-way vents that are configured to open from one side at a first pressure and to resist air flow from another direction up to an operational pressure range of the one-way vent that is substantially higher than the first pressure. For example, the one-way vent may open when an interior pressure differential of approximately +1 PSI is applied to the interior of the vent, and resist exterior pressures of several atmospheres or more. The pressure vent may include, for example, a rigid flapper valve that is mechanically braced to withstand positive pressure differential on an exterior of the valve, and spring closed to open with an +0.8 PSI pressure on the interior of the valve. The atmospheric venting/purge system may include a pressure assist device to generate a positive pressure differential against the interior of the valve, such as an exhaust fan. Very extreme pressures such as those encountered during an exterior explosion could also be mitigated by having the exterior wall cavity of the unit pressurize itself as an individualized compartment. Exterior sensors reading an extremely high pressure could generate, by a variety of means, the release of a large quantity of highly compressed gas either stored or manufactured there. The generation of this high pressure gas into the exterior wall cavity at the instant of the shock wave from the explosion would minimize the damage to the unit by temporarily fortifying it to the necessary yield points. Valves, regulators, as well as pop-offs could be installed in such a way as to allow the pressurization of the chamber, the impact of the shock wave, and the necessary depressurization of the exterior wall to occur in a correct and timely fashion thereby maximizing the protection of the occupants in the mine unit.

Embodiments may include an atmospheric system including means for cleaning, supplementing, and/or otherwise modifying an interior atmosphere of the shelter. The atmospheric system may include, for example, a pressurized, and/or chemical, gas supply system, a physical, and/or chemical, air cleaning system, a humidity control system, and the like. Embodiments may also include the shelter being configured with an atmospheric exchange system, and/or a control system that operates the atmospheric exchange system, to selectively transmit an atmospheric gas from one area of the shelter to another area of the shelter. In embodiments, air movement subsystems of the various atmospheric systems may include fans powered by a pressurized gas.

Embodiments may include an atmospheric monitoring system with a plurality of monitoring sensors. Monitoring sensors may be included in, for example, a living area, an entry chamber and/or an exterior of the shelter. Monitoring sensors may include N (nitrogen), $O_2$, CO, $CO_2$, $CH_4$ (methane), pressure, temperature, humidity sensors, and the like. The atmospheric monitoring system may include a panel with different indicator areas for presenting the readings from sensors in different areas of the shelter.

Embodiments of the shelter may also include an exterior door. The exterior door may include a first seal and/or a second seal. The second seal may be configured to automatically open in response to a positive air pressure differential on an interior surface of the exterior door, such as, for example approximately a +15 PSI air pressure on the interior surface of the exterior door. Embodiments may also include an opening mechanism that is configured to manually open the first seal from inside the shelter. The opening mechanism may include a piston and an assist mechanism that may be configured to assist in overcoming a positive pressure differential on an exterior surface of the exterior door, such as, for example approximately a +15 PSI air pressure on the exterior surface of the exterior door.

Embodiments of the shelter may include an entry chamber that includes an exterior door. The entry chamber may be attached to a living chamber or an antechamber of the shelter. In embodiments, the shelter may be configured to maintain the living chamber at a higher pressure than a pressure of the entry chamber. The shelter may include a soft seal door between the entry chamber and the living chamber or the antechamber, and/or between separate living areas of the shelter. The soft seal door may be configured to assist in maintaining the higher pressure in the living area. Embodiments may include the soft seal door being configured to maintain at least partial contact with the body of a user while the user passes through the soft seal door.

As used herein, maintaining at least partial contact with the body of a user should be understood as including partial contact with a body part of the user other than hand-to-handle contact found in the operation of a conventional door. For example, a soft seal door may be configured to maintain partial contact with a torso, arm, leg, and/or head of the user as the user transits through the soft seal door. The term "maintain partial contact" is not limited to a specific period of time, and can include transitory partial contact during transit through the soft seal door. In embodiments, the soft seal door may be configured to partially mold to the body of the user as the user transits through the soft seal door. The soft seal door may include one or more layers of flexible material with cuts that allow a user to penetrate the soft seal door. A plurality of the cuts may intersect at a nexus. In embodiments with two, or more, layers of flexible material, two or more of the layers may have non-coincident nexuses, and/or cut axes.

Embodiments of the shelter may include a mating device configured to connect to an external supply hose. The external supply hose may be used to supply the shelter with a gas and/or a liquid from outside of the shelter. The mating device may include an airflow control valve and/or a first mating surface configured to connect to a supply hose. The supply hose may be a relatively large diameter hose, for example a hose having a diameter of approximately 4 inches or greater. In embodiments, the shelter may also include a supply hose configured for use with the first mating surface. The supply hose may include a second mating surface on a first end of the supply hose. The second mating surface may be configured to attach to the first mating surface of the mating device. The supply hose may also include an adjustable mating surface at a second end of the supply hose. The adjustable mating surface may attach to the supply hose and may be adjustable to a range of diameters. The adjustable mating surface may be adjusted, for example, via a turning mechanism on the second end of the supply hose or otherwise attached to the adjustable mating surface.

Embodiments may include a modular shelter kit with parts to assemble a modular shelter as described herein. For example, a modular shelter kit may include a plurality of wall units, each of the plurality of wall units sharing a substantially common shape and substantially common dimensions. The kit may include a base unit that extends substantially throughout a floor plan of an assembled structure of the kit and/or a roll cage that surrounds an outer extent of the assembled shelter above the floor plan.

The plurality of wall units in the kit may be configured to form at least part of a wall, ceiling and/or floor of the assembled shelter. The kit may also include interior brackets that are configured to join the wall units together along seams, and/or a sealant that may assist in forming seals along edges and corners of connected wall units.

Embodiments of the modular shelter kit may include a base unit that extends substantially throughout a floor plan of the shelter. The base unit may be configured to be located underneath a floor of the assembled shelter and may include a plurality of modular base pieces. Each of the modular base pieces may share a substantially common shape and substantially common dimensions. The base unit included in the kit may also include edge pieces or other pieces that are shaped differently than the plurality of base pieces.

Embodiments of the modular shelter kit may also include a roll cage that surrounds an outer extent of the assembled shelter above the floor plan. The roll cage may be configured to attach to the base unit and/or walls, ceiling and/or floor of the assembled shelter. Embodiments of the modular shelter kit may be configured to allow the assembled shelter to be lifted by a boom point on the roll cage, and/or dragged and/or pushed along an exterior surface by a boom point and/or a hard point on the base unit.

Embodiments of the modular shelter kit may also include the assembled shelter being configured to maintain a pressurized state in a closed condition. For example, the modular shelter kit may be configured such that the assembled shelter may selectively withstand a pressure differential in a range of approximately ±15 PSI between an interior of the assembled shelter and an exterior of the assembled shelter. Embodiments of the modular shelter kit may also include an atmospheric venting and/or purge system, and a control system that operates the atmospheric venting/purge system to selectively force an atmospheric gas from within the assembled shelter to an outside of the assembled shelter. The atmospheric venting/purge system may include one or more one-way vents that are configured to open from one side at a first pressure and to resist air flow from another direction up to an operational pressure range of the one-way vent that is substantially higher than the first pressure. The one-way vent may include, for example, a rigid flapper valve that is mechanically braced to withstand positive pressure differential on an exterior of the valve, and spring closed to open with an +0.8 PSI pressure on the interior of the valve. The atmospheric venting/purge system may include a pressure assist device to generate a positive pressure differential against the interior of the valve, such as an exhaust fan.

Embodiments of the modular shelter kit may include an atmospheric system including means for cleaning, supplementing, and/or otherwise modifying an interior atmosphere of the assembled shelter. The atmospheric system may include, for example, a pressurized, and/or chemical, gas supply system, a physical, and/or chemical, air cleaning system, a humidity control system, and the like. Embodiments of the modular shelter kit may also include an atmospheric exchange system, and/or a control system that operates the atmospheric exchange system, to selectively transmit an atmospheric gas from one area of the assembled shelter to an other area of the shelter. In embodiments, air movement subsystems of the various atmospheric systems may include fans that are powered by pressurized gas.

Embodiments of the modular shelter kit may include an atmospheric monitoring system with a plurality of monitoring sensors. Monitoring sensors may be included in, for example, a living area, an entry chamber and/or an exterior of the shelter. Monitoring sensors may include N (nitrogen), $O_2$, CO, $CO_2$, $CH_4$ (methane), temperature, humidity sensors, and the like. The atmospheric monitoring system may include a panel with different indicator areas for presenting the readings from sensors in different areas of the shelter.

Embodiments of the modular shelter kit may also include an exterior door for the assembled shelter. The exterior door may include a first seal and/or a second seal. The second seal may be configured to automatically open in response to a positive air pressure differential on an interior surface of the exterior door, such as, for example approximately an approximately +15 PSI air pressure on the interior surface of the exterior door. Embodiments of the modular shelter kit may also include an opening mechanism that is configured to manually open the first seal from inside the assembled shelter. The opening mechanism may include a piston and an assist mechanism that may be configured to assist in overcoming a positive pressure differential on an exterior surface of the exterior door, such as, for example an approximately +15 PSI air pressure on the exterior surface of the exterior door.

Embodiments of the modular shelter kit may be configured such that an entry chamber with an exterior door is included in the assembled shelter. The modular shelter kit may be configured such that the entry chamber is attached to a living chamber or an antechamber of the assembled shelter. In embodiments, the modular shelter kit may be configured such that the assembled shelter maintains the living chamber at a higher pressure than a pressure of the entry chamber. The modular shelter kit may include a soft seal door configured to be placed between the entry chamber and the living chamber or the antechamber, and/or between separate living areas of the assembled shelter. The soft seal door may be configured to assist in maintaining the higher pressure in the living area. Embodiments may include the soft seal door being configured to maintain at least partial contact with the body of a user while the user passes through the soft seal door.

In embodiments, the soft seal door may be configured to partially mold to the body of the user as the user transits through the soft seal door. The soft seal door may include one or more layers of flexible material with cuts that allow a user to penetrate the soft seal door. A plurality of the cuts may intersect at a nexus. In embodiments with two, or more, layers of flexible material, two or more of the layers may have non-coincident nexuses, and/or cut axes.

Embodiments of the modular shelter kit may include a mating device configured to connect to an external supply hose. The external supply hose may be used to supply the shelter with a gas and/or a liquid from outside of the shelter. The mating device may include an airflow control valve and/or a first mating surface configured to connect to a supply hose. The supply hose may be a relatively large diameter hose, for example a hose having a diameter of approximately 4 inches or greater. In embodiments, the modular shelter kit may also include a supply hose configured for use with the first mating surface. The supply hose may include a second mating surface on a first end of the supply hose. The second mating surface may be configured to attach to the first mating surface of the mating device. The supply hose may also include an adjustable mating surface at a second end of the supply hose. The adjustable mating surface may attach to the supply hose and be adjustable to a range of diameters. The adjustable mating surface may be adjusted, for example, via a turning mechanism on the second end of the supply hose, or otherwise attached to the adjustable mating surface.

Embodiments include a method of assembling a modular shelter such as those modular shelters and modular shelter kits discussed herein. Embodiments may include assembling a base unit that extends substantially throughout a floor plan of the assembled modular shelter. The base unit may be assembled from a group of pieces including a plurality of modular base pieces, each of the modular base pieces sharing a substantially common shape and substantially common dimensions. The base unit assembly may also include edge pieces or other pieces that are shaped differently than the plurality of base pieces.

Embodiments may include assembling at least two wall units to form a substantially air-tight seal along a seam between the at least two wall units. Each of the at least two wall units may share a substantially common shape and substantially common dimensions. The at least two wall units may form an assembly of at least part of a wall, a ceiling, and/or a floor, or a combination thereof, of the assembled shelter.

Embodiments may include attaching a roll cage to at least one of the wall unit assembly and the base unit. The roll cage may surround an outer extent of the modular shelter above the floor plan. Embodiments may include sealing the modular shelter such that the assembled modular shelter maintains a pressurized state in a closed condition. For example, the shelter may be sealed to selectively withstand a pressure differential in a range of approximately ±15 PSI between an interior of the shelter and an exterior of the shelter. In embodiments, the shelter may be sealed to withstand a greater exterior pressure differential than an interior pressure differential. For example, the shelter may withstand an exterior pressure differential of approximately +15 PSI, or more, and allow venting of an interior pressure of approximately +1 PSI.

In embodiments, the wall unit assembly may include a plurality of floor units sharing the substantially common shape and substantially common dimensions of the at least two wall units.

Embodiments may include lifting, sliding, and/or pushing the assembled modular shelter to an operating position in an underground environment via a boom/hard point on the roll cage and/or the base unit.

Further advantages and aspects of the present subject matter will become apparent to those of ordinary skill in the art upon reading and understanding the following detailed description of embodiments of the invention.

BRIEF DESCRIPTION OF THE DRAWINGS

FIGS. 22A-22D depict aspects of an exemplary mating device and supply hose, in accordance with embodiments of the invention.

DETAILED DESCRIPTION OF THE INVENTION

The following detailed description is provided with reference to exemplary embodiments for the ease of description and understanding. Applicants' invention is not limited to the disclosed embodiments, and encompasses other variations that fall within the overall scope of description provided herein and as enumerated in claims.

Aspects of an modular underground shelter including a safety chamber as disclosed herein may include features that allow the shelter to be assembled and then moved by lifting, dragging, and/or pushing the assembled shelter via hard points on a roll cage and/or base unit into an operating position in an underground environment. An external roll cage around the shelter may also be used to absorb stresses of moving or accidental impact in order to protect a safety chamber of the shelter.

Figures 1A, 1B, 1C:
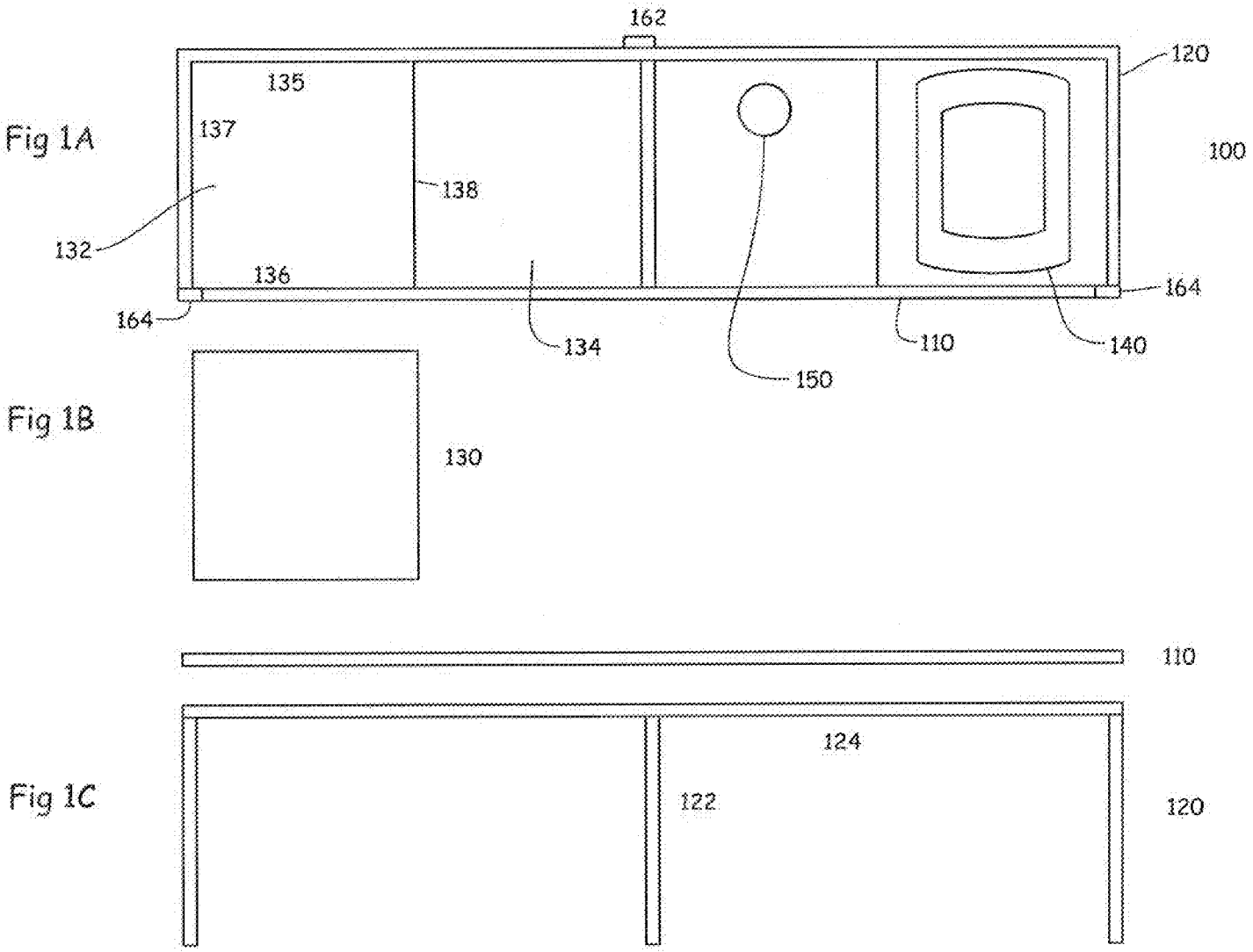
FIGS. 1A-1C depict an exemplary modular structure and associated parts, in accordance with embodiments of the invention.

As depicted in FIGS. 1A-1C, embodiments of the present subject matter include a modular shelter 100 with a plurality of wall units 130, as seen in FIG. 1A. The wall unit 130 may be, for example, a substantially rectangular sheet of metal, fiberglass, plastic or the like, with attachment points, such as folded edges, along the perimeter, as shown in FIG. 1B. Exemplary wall units 130 share a substantially common shape and substantially common dimensions. In the case of wall pieces 130 that have edges that connect to a different surface, e.g. wall to ceiling 135, wall to floor 136, wall corner or side 137, the specific shape of the edge may be different from the edge along seal 138 to account for differences in joining the different surfaces. However, such differences should be understood as still falling within the meaning of the wall pieces sharing a substantially common shape and substantially common dimensions. For example, a wall unit 132 may share a substantially common shape and substantially common dimensions with wall unit 134, despite differences in mating surfaces along the edges of the wall units.

As shown in FIG. 1, a plurality of the wall units 130 can be used to form a wall of shelter 100. As noted previously, and discussed further below, wall units, such as 130, may be assembled to form walls, ceilings, floors, and the like. The wall units 130 may be connected along substantially sealed seams 138. Embodiments may include the wall units being connected, in part, by interior brackets along seams 138. The interior brackets may be a U or L bracket, or the like, and may be used, for example, to assist in compressing folded edges of the wall units 130 together. Seams 138 between the wall units may also include other formed connectors, and/or a sealant, that may assist in forming a substantially air-tight seal along edges and corners of connected wall units. The shelter may include exterior doors 140, vents 150, (mating surfaces (not shown) and the like. As discussed further below, attachments to the exterior of the shelter, particularly those that penetrate the walls of the safety chamber, may be configured to maintain the shelter in a pressurized state. Thus, features such as doors 140, vents 150, etc., may include additional features that allow them to be sealed and selectively opened, as needed. FIG. 2 shows side and top views of shelter 100, and a side view of roll cage 120 and base unit 110.

Figure 2B:
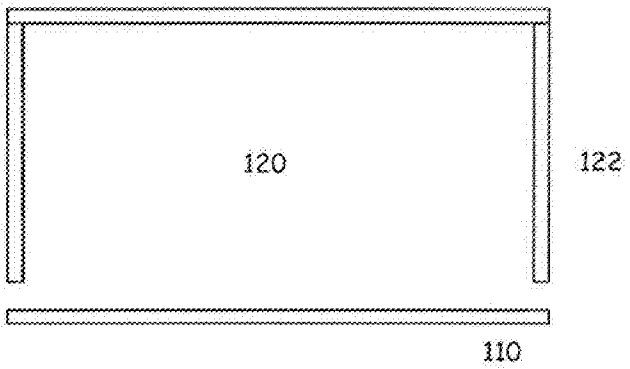
FIGS. 2A-2C depicts an exemplary modular structure and associated parts, in accordance with embodiments of the invention.
Figure 2A:
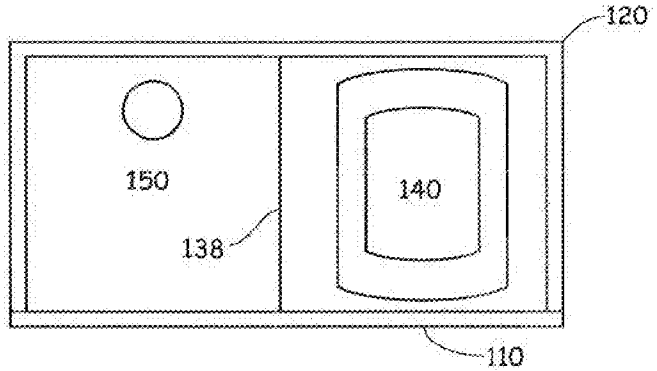
Figure 2C:
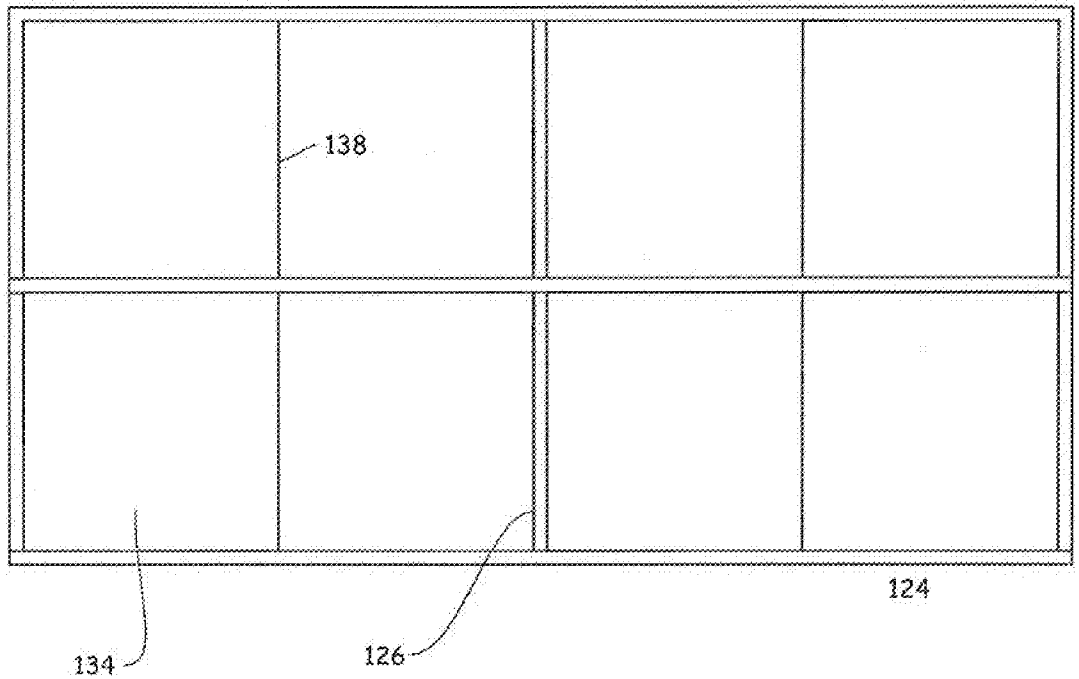

With further reference to FIGS. 1 and 2, the modular shelter 100 may include a base unit 110 that extends substantially throughout a floor plan of the shelter. The base unit 100 is shown as located underneath a floor (not shown) of the shelter and forms a "pan" that can be used to slide the entire shelter along the ground without damaging the safety chamber, as can be seen in FIGS. 1C and 2B. This can be particularly helpful in placing underground shelters in an operating position in tunneled spaces that may have limited accessibility and room for burdensome assembly processes. FIGS. 1C and 2B show the exemplary base unit 110 from a front and a side view, respectively. FIGS. 2A and 2C show an exemplary side and top view of shelter 100, respectively.

Figure 3:
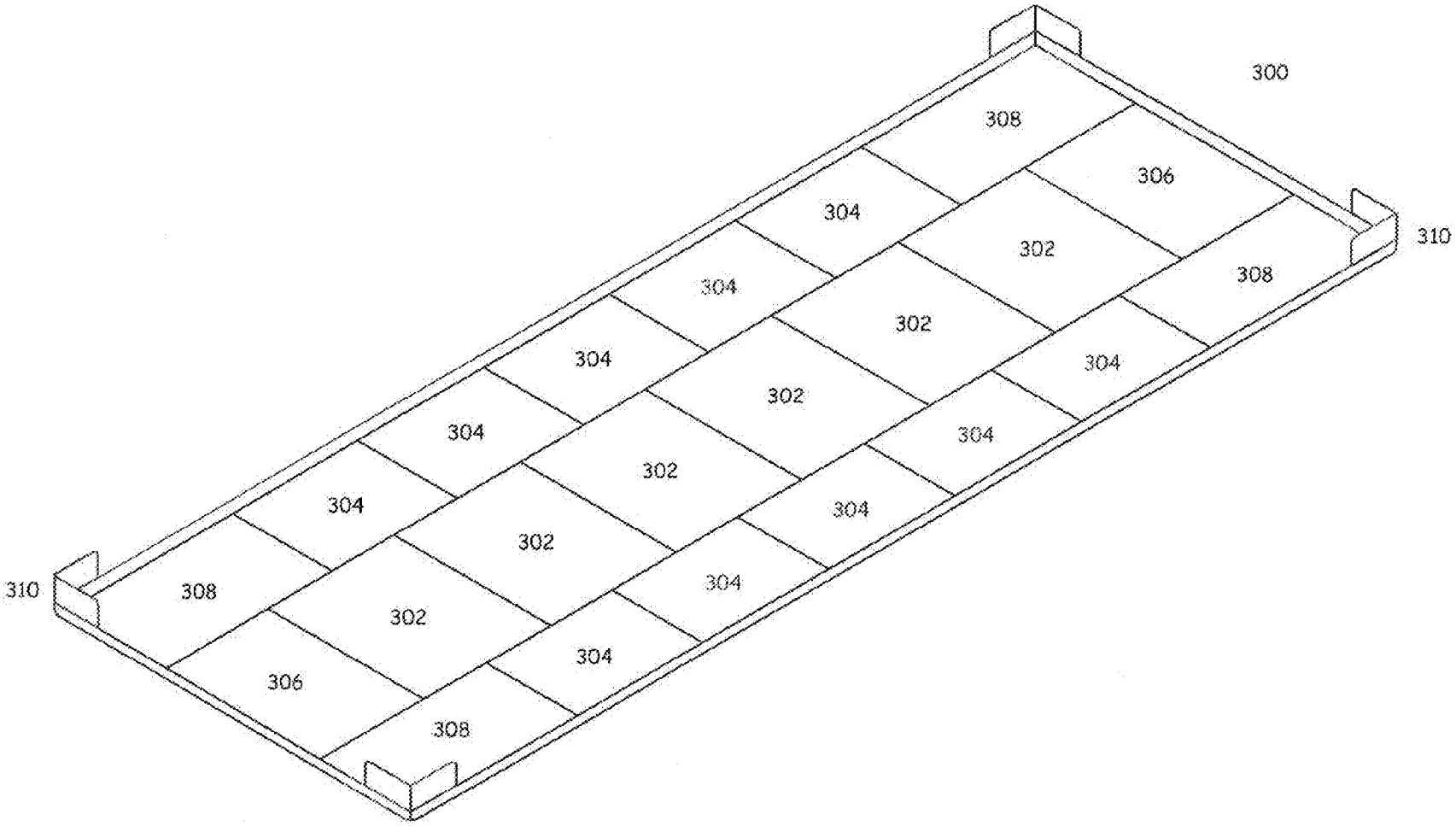
FIG. 3 depicts an exemplary base unit, in accordance with embodiments of the invention.
Figure 4:
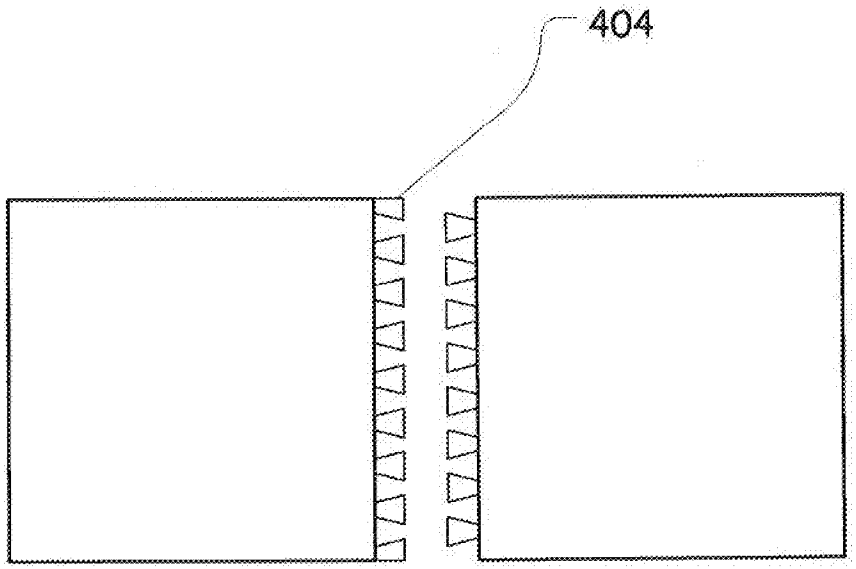
FIG. 4 depicts parts of an exemplary base unit, in accordance with embodiments of the invention.

Further details of an exemplary base unit 300, similar to base unit 110, are shown in FIG. 3. As shown in FIG. 3, the base unit 300 may include a plurality of modular base pieces 302 that share a substantially common shape and substantially common dimensions. The base unit may also include groups of similarly shaped pieces, such as edge pieces 304, 306, corner pieces 308, or other pieces, that are shaped or dimensioned differently than the plurality of base pieces 302. Any of groups 302, 304, 306, 308, and the like, may be understood as including a plurality of modular base pieces, each of the modular base pieces sharing a substantially common shape and substantially common dimensions. Pieces of the base unit 300 may be joined together in various ways. For example, as depicted in FIG. 4, pieces of the base unit may be joined together by interlocking teeth 404 along some, or all, of edges of the pieces in order to securely lock the base unit together and provide a solid base unit for lifting, pulling and pushing the shelter. The base unit 300 may also include hard points 310 on corners of the base unit 300, that may add additional resistance and functionality to the base unit.

Referring back to FIG. 1, the modular shelter 100 is shown with a roll cage 120 that surrounds an outer extent of the shelter above the floor plan, e.g. around a safety chamber. FIGS. 1C and 2B show the exemplary roll cage 122, from a front and a side view, respectively. The roll cage 120 is preferably attached to the base unit 110, but may also be attached to the walls, ceiling and/or floor of the shelter 100. The shelter 100 includes a boom point 162 on the roll cage 120, and hard points 164 on the base unit 110.

Figure 5:
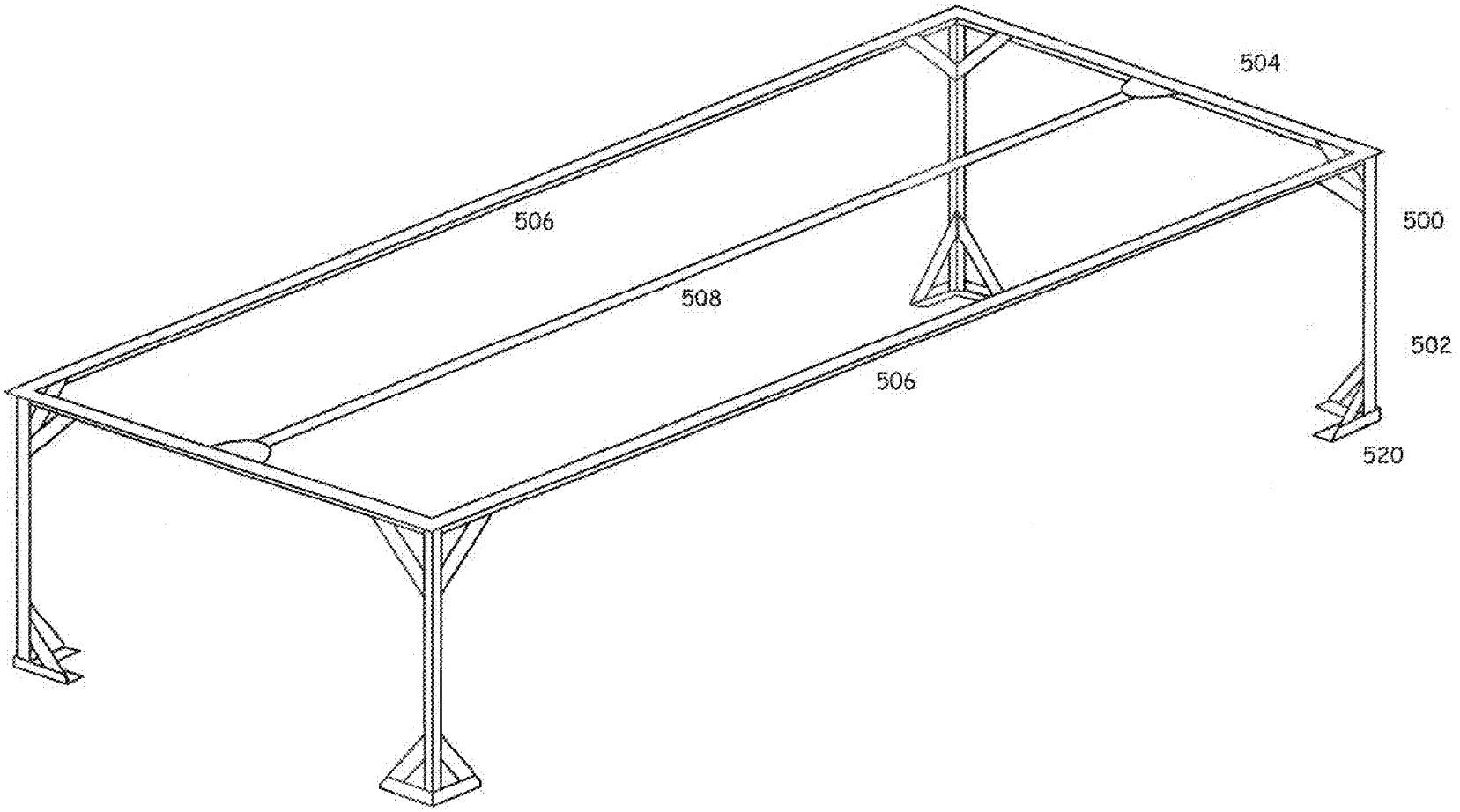
FIG. 5 depicts an exemplary roll cage, in accordance with embodiments of the invention.

FIG. 5 provides additional details of an exemplary roll cage 500, similar to roll cage 120. As shown in FIG. 5, roll cage 500 may be assembled with vertical supports 502, lateral supports 504, transverse supports 506, 508, and additional supports depending on the size and configuration of the shelter. The various supports may be included as a modular kit, or preformed as an integral unit. It should be noted that, although depicted in rectangular form for ease of description, the overall shape of the shelter, roll cage, and base unit is not limited to rectangular configurations, and can include other more irregularly shaped configurations depending on the requirements of the user. As shown in FIG. 5, the roll cage 500 may also include support structures 520 for securely attaching the roll cage 500 to a base unit. Depending on the overall size and weight of the assembled structure, the support structures 520 may be increased in size and strength to adequately support lifting, pushing and/or pulling the shelter via the roll cage and the base unit.

Figure 6:
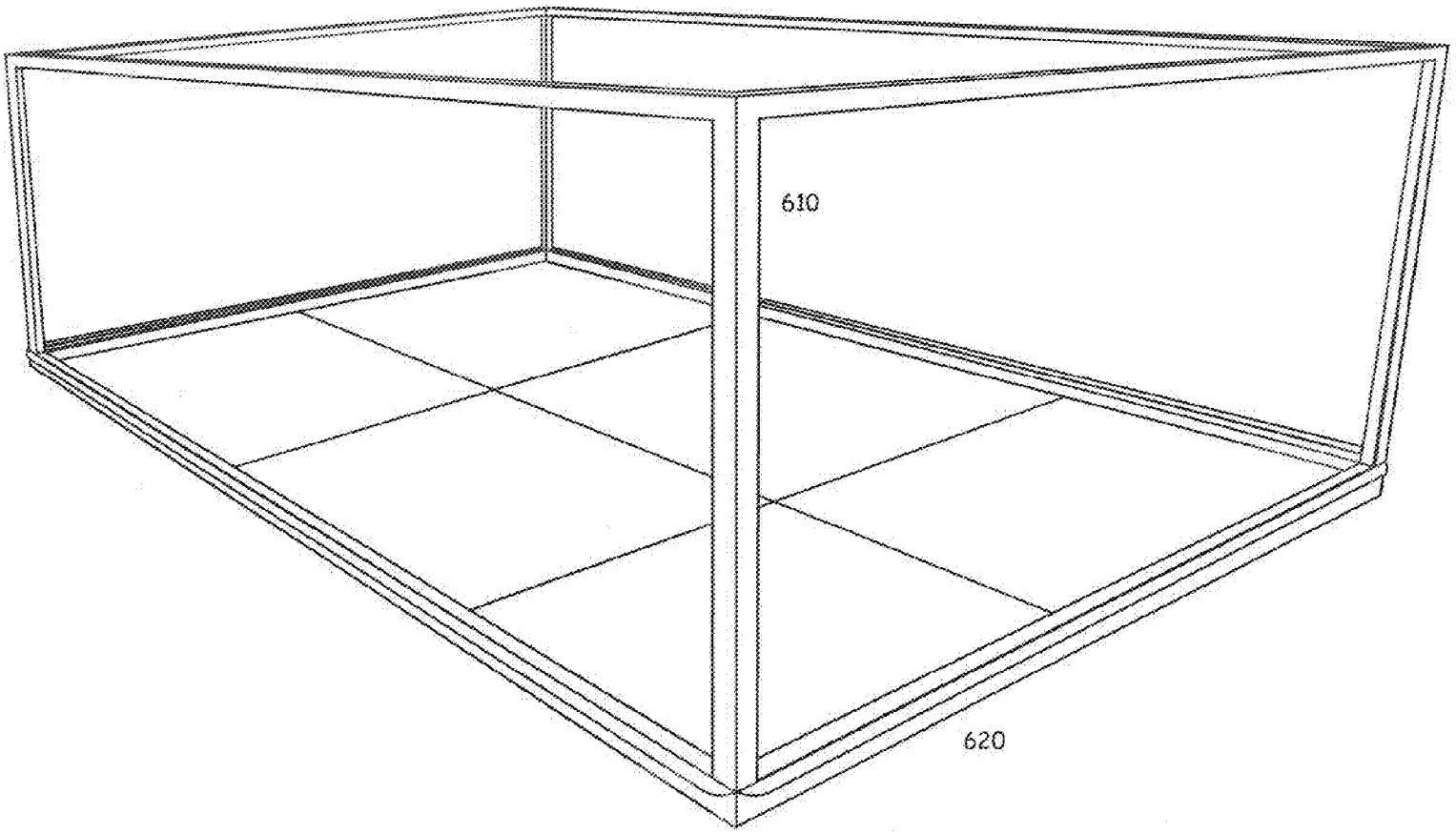
FIG. 6 depicts an exemplary base unit and roll cage, in accordance with embodiments of the invention.

According to embodiments, such as the configuration depicted in FIG. 1, a roll cage such as roll cage 120 may be used as a booming point for the purpose of moving an assembled shelter, such as shelter 100. The booming point 162 may also be used to provide stability while moving the shelter 100. In embodiments, a tow unit (not shown) may be used to lift a front of the base unit 110 into a dragging position via selected hard points 164. The ability to effectively lift and drag the shelter 100 is a function of the base unit and roll cage, that allow the shelter to be fastened from any side and moved into position from any direction via lifting, pulling and pushing the roll cage 120 and/or the base unit 110. As shown in FIG. 1, hard points 164 may also allow for pushing on an individual corner of the shelter 100 to induce rotational movement. Although the base unit 110 may include a plurality of modular base pieces, the structural integrity of the base unit 110 is typically stronger than the assembly of wall units 130, and is sufficiently strong to allow for the described lifting, pulling and pushing of the assembled shelter 100. FIG. 6 shows an example of a roll cage 610 assembled to a base unit 620. Depending on the configuration of the shelter, the roll cage 610 may be assembled and attached to the base unit 620 after the shelter wall units are assembled on the base unit 620.

Figure 7:
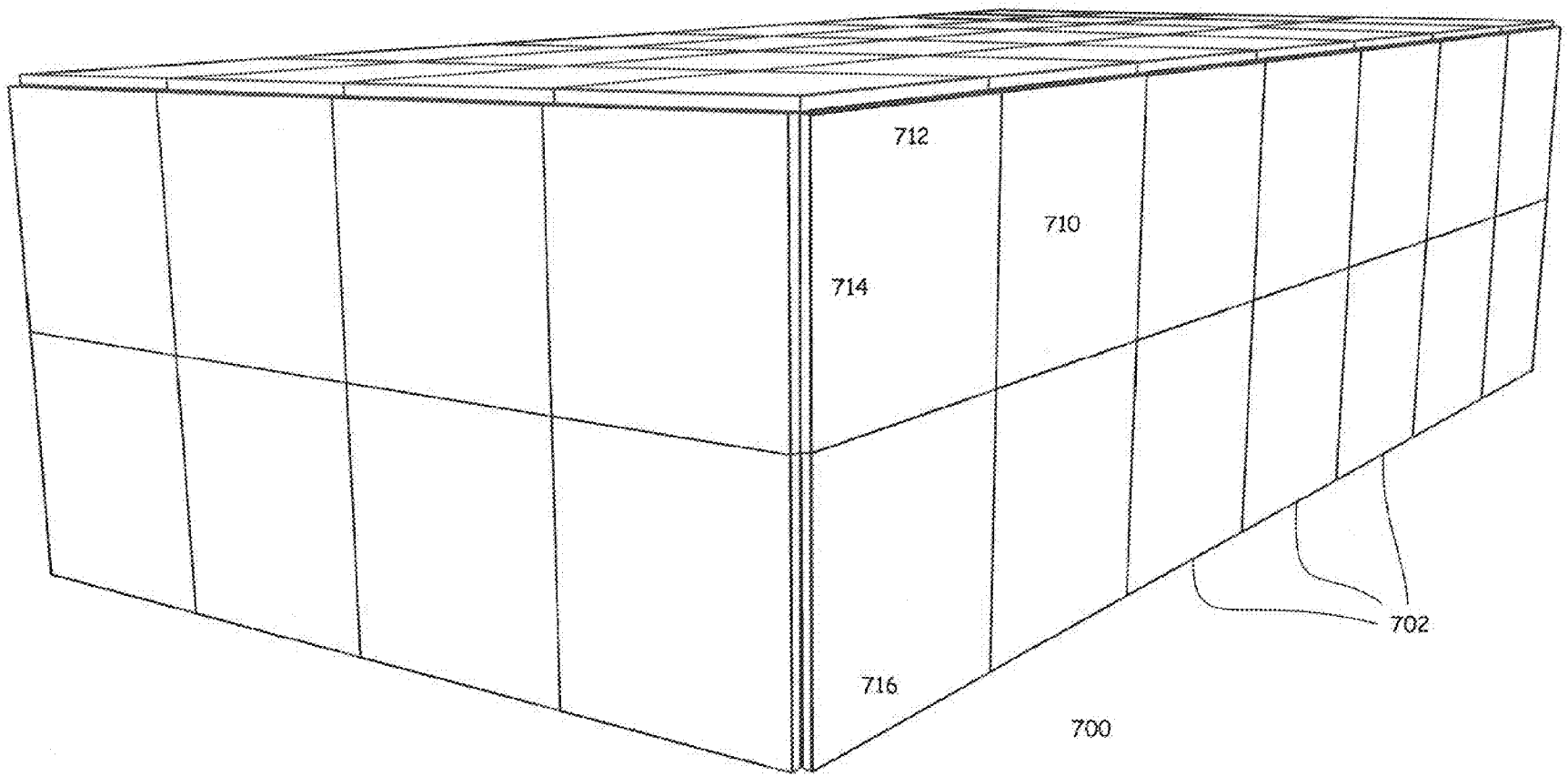
FIG. 7 depicts an exemplary safety chamber, in accordance with embodiments of the invention.
Figure 8:
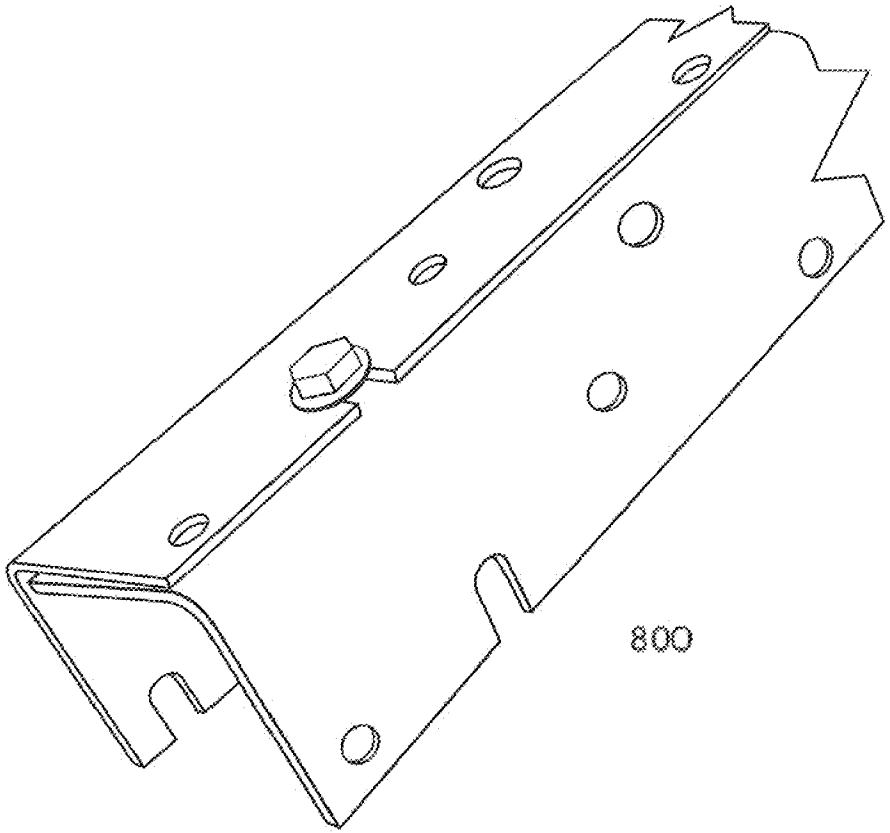
FIG. 8 depicts an exemplary bracket, in accordance with embodiments of the invention.

As depicted in FIG. 7, the walls, roof, and/or floor of a safety chamber 700 may be assembled from a series of modular wall unit components 702, forming sealed edges e.g. 710, 712, 714 and 716. In the embodiment shown in FIG. 7, one wall is composed of a 2×7 arrangement of 14 wall units 702 and another wall is composed of a 2×4 arrangement of 8 wall units 702. A ceiling and floor (not shown) may each be composed of a 4×7 arrangement of 28 wall units 702. The wall units 702 may be clamped together by a series of fasteners, such as U or L brackets, such as U bracket 800 shown in FIG. 8, allowing compression of a variety of sealing materials between them, and allowing the modular safety chamber to withstand forces similar to a solid unit. For example, the safety chamber may be configured to withstand pressures of up to 15 PSI on the outer surface, thereby mitigating or preventing damage to the structure. Internal walls may be included as well.

Figure 9:
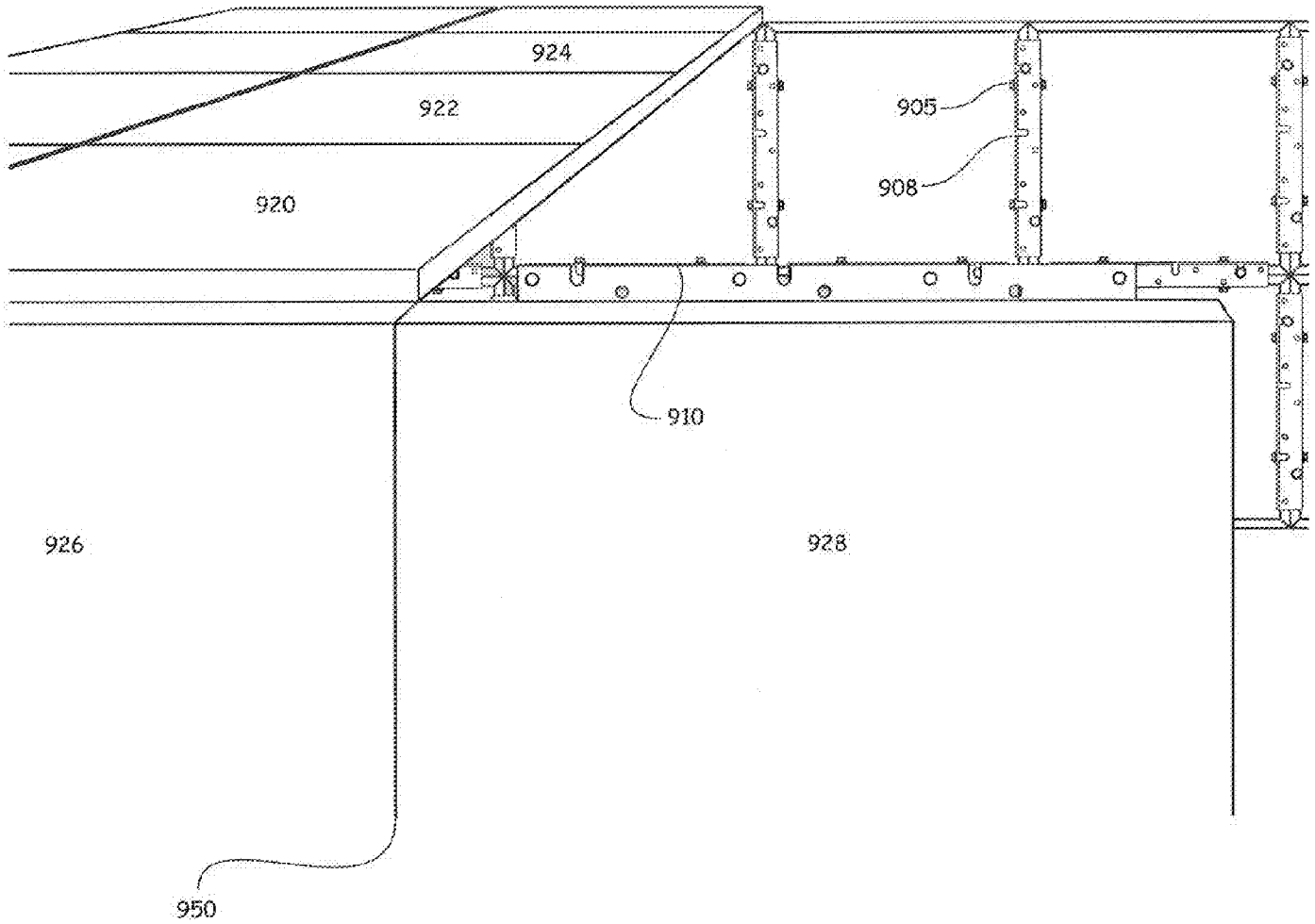
FIG. 9 depicts an exemplary partially assembled safety chamber, in accordance with embodiments of the invention.

With reference to FIG. 9, threaded fasteners 905 may be used to clamp components together, such as in a sandwich configuration, with edges 910 of abutting wall units being pressed toward one another by a bracket, such as U bracket 908. It is noted that items, such as the sealing mechanism between the wall units, are described for exemplary purposes only. Other means of securing the wall units together and achieving sealed edges between abutting wall units, such as, for example, along edge 950, are contemplated within the scope of the present invention. As can also be seen in FIG. 9, an entire safety chamber may be constructed from similarly shaped and dimensioned wall units. That is, the entire outer surface of the walls, ceiling and floor may be assembled from parts of similar dimension, such as the substantially square units 920-928.

Figure 10:
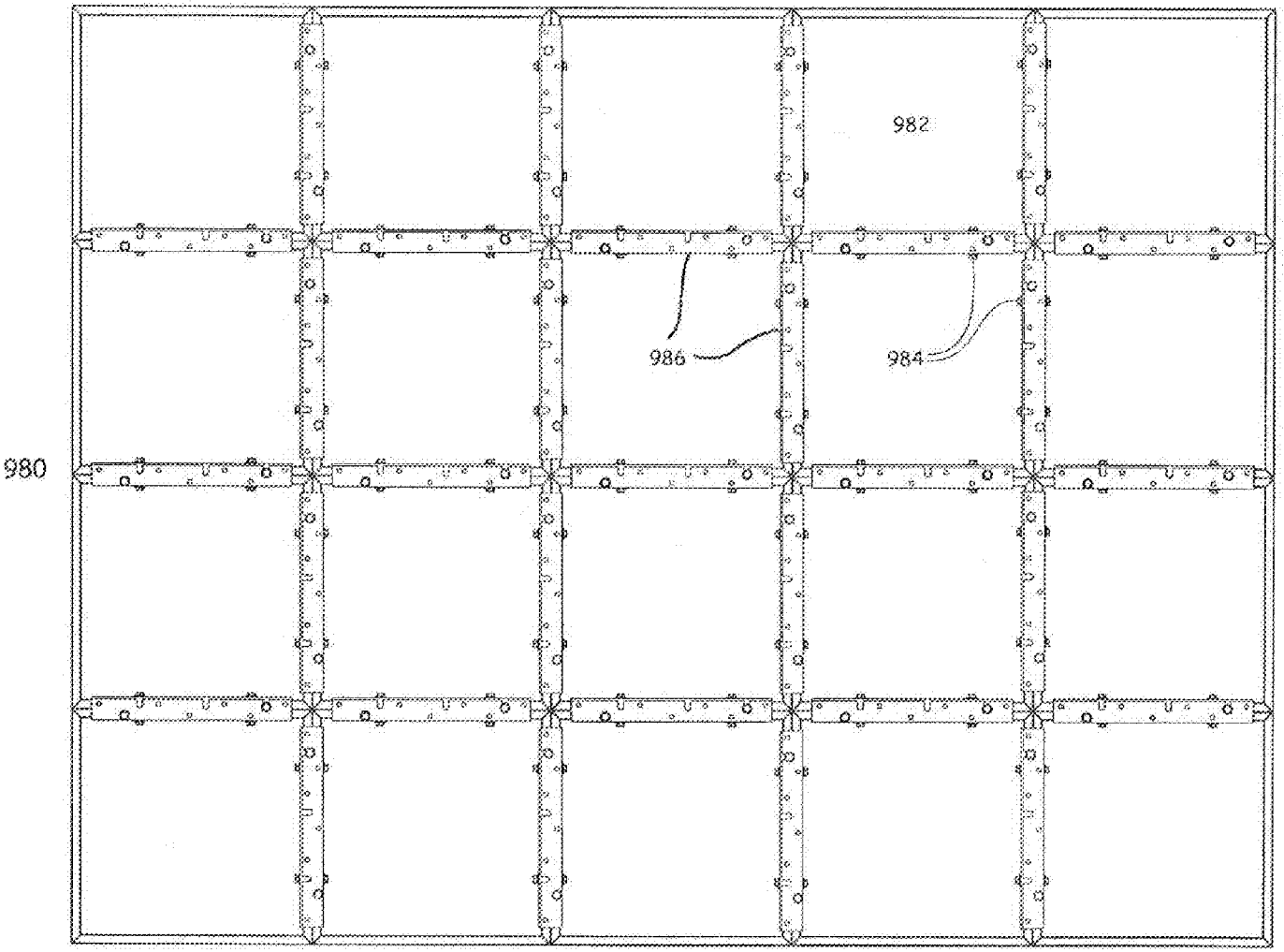
FIG. 10 depicts an exemplary floor, in accordance with embodiments of the invention.

FIG. 10 provides additional details of an exemplary wall assembly 980, in this case a floor assembly, with wall units 982, threaded fasteners 984 and U brackets 986. In embodiments, a floor, such as assembly 980, may be assembled on top of a base unit, such as in circumstances with a large floor plan that may not withstand lifting without the increased strength of the base unit.

As discussed herein, the safety chamber is designed to modularly expand depending upon the amount of room required of, or available for, the structure in the underground work environment. Thus, the shelter may be made available in a variety of shapes, heights, widths, and lengths according to its modular design. Designing the system in a modular manner provides improved flexibility and utility for the structure beyond that which is currently available, and is particularly useful for underground applications. Modular construction further allows the manufacturer to offer the customer a wide variety of configurations at a significantly reduced cost compared to a comparable range of separately designed and constructed structures.

As described herein, the shelter may be configured to maintain a pressurized state in a closed condition. The pressurized state may include a negative and/or positive pressure differential on the interior of the shelter. For example, the shelter may be configured to selectively withstand a pressure differential in a range of approximately ±15 PSI between an interior of the shelter and an exterior of the shelter. In embodiments, the shelter may be configured to withstand a greater positive exterior pressure differential than an interior positive pressure differential. For example, the shelter may withstand an exterior pressure differential of approximately +15 PSI, or more, and allow venting of an interior pressure at approximately +1 PSI. Thus, occupants of the shelter may be protected from an overpressure situation in the safety chamber by automatically venting the interior atmosphere at approximately +0.8 PSI, while also protecting the occupants from a sudden increase in the external pressure. Such pressure resistance may serve a number of purposes in an underground work environment, such as maintaining a breathable atmosphere in the safety chamber despite a contaminated, or otherwise harmful, outer atmosphere, which may be subjected to variations in ambient pressure. Venting may provide an additional safety measure when breathable gas, such as oxygen or air, is forcibly introduced into the safety chamber. Maintaining an interior pressure above the exterior pressure may also allow occupants to exit the structure with reduced risk of introducing harmful particulate matter or gases from the exterior environment.

Figure 11:
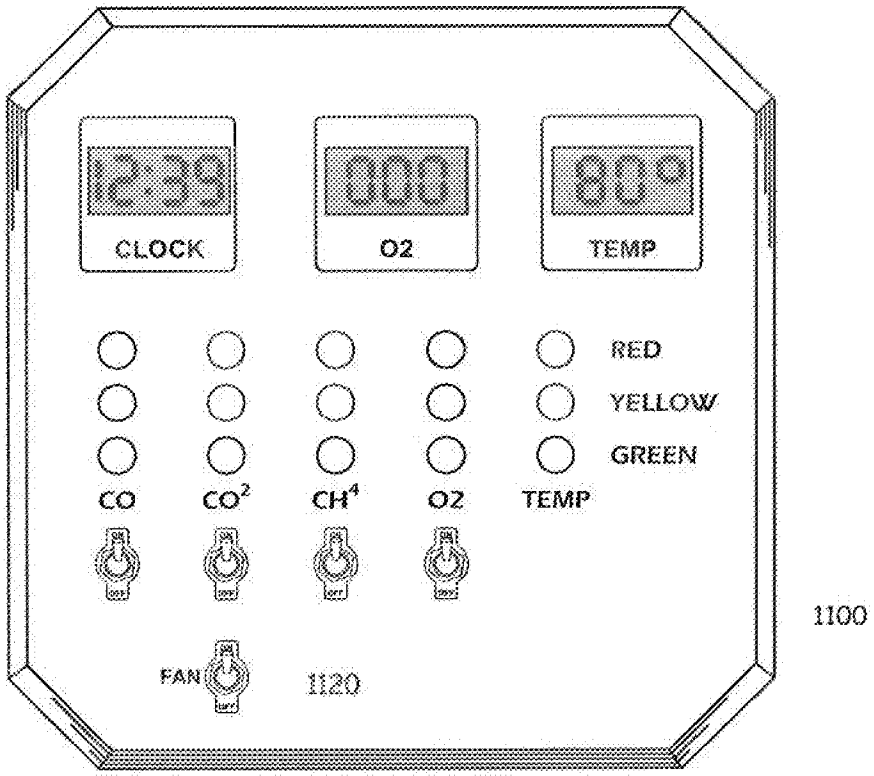
FIG. 11 depicts an exemplary sensor panel, in accordance with embodiments of the invention.

FIG. 11 shows an example of a control panel 1100 of an atmospheric monitoring system with a plurality of monitoring sensors. Control panel 1100 shows intuitive displays for levels of CO, $CO_2$, $CH_4$, $O_2$ and temperature. A gas analyzer can be used with the control panel for the purpose of lighting a series of LED boards for easy visual understanding of the gas concentrations. Additional audible alarms may be included in the system for dangerous conditions. Other readings may also be included in control panel 1100, as appropriate. Control panel 1100 includes a control 1120 for turning on and off a fan that may be used to purge or circulate air, depending on the location of the fan.

Figure 12:
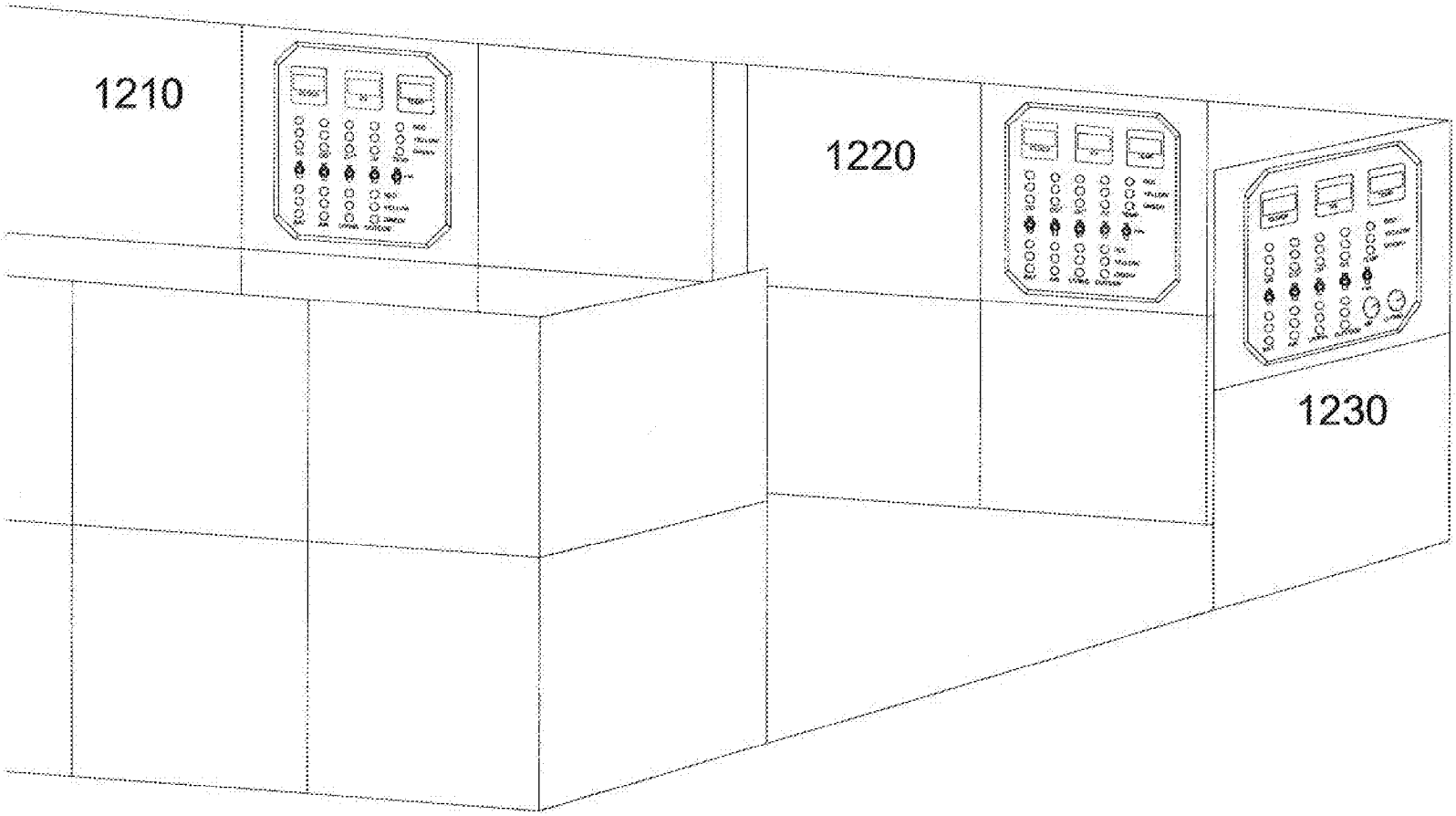
FIG. 12 depicts an exemplary shelter including several sensor panels, in accordance with embodiments of the invention.

Monitoring sensors may be included in, for example, a living area, an entry chamber and/or an exterior of the shelter. Monitoring sensors may include N, $O_2$, CO, $CO_2$, $CH_4$, pressure, temperature, humidity sensors, and the like. As shown in FIG. 12 The atmospheric monitoring system may include control panel(s) 1210, 1220, and 1230, with different indicator areas for presenting the readings from sensors in different areas of the shelter. Thus, an occupant in one area of the shelter can monitor the conditions in another part of the shelter, or outside, and execute necessary controls for tasks such as purging an interior atmosphere, assisting an occupant in leaving or entering the shelter, etc.

Similar, or different, control stations may be located in the living area, in the entry chamber, and around the outside of the unit to measure a wide variety of environmental conditions and gases. The control panels may assist in the introduction or removal of gases to or from the interior by supply, circulation, and purge systems, as discussed further below.

An exemplary air monitoring component may fit inside a standard wall unit used for the modular shelter, and may include its own self-contained electrical system containing a power supply such as sealed NICAD batteries, as well as an external component to gain extra electricity if necessary. Embodiments may include time-stamped readings of $O_2$, $CO_2$, $CH_4$, and the temperature with a visible and audible alarm capacity, which can be used for analysis and corrective action. For example, a fan may be controlled to draw air past a particular sensor pack should any of the gases monitored by the sensor pack elevate or decrease to a given level. Color-coded reading levels may be set for each of the monitored criteria such as gas concentration, temperature, humidity and the like. Multiple monitoring units may be tied together in order to monitor the display from any of the panels in, or outside of, the shelter.

Figure 13:
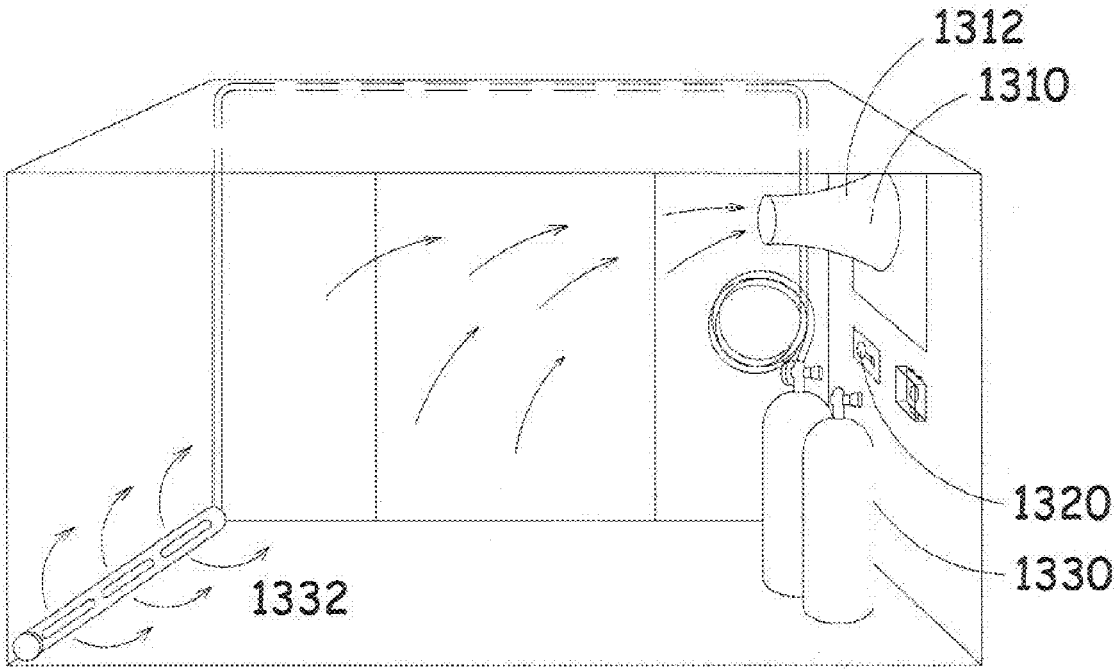
FIG. 13 depicts an exemplary purge system, in accordance with embodiments of the invention.

Embodiments may also include an atmospheric system with means for cleaning, supplementing, and/or otherwise modifying an interior atmosphere of the shelter. The atmospheric system may include, for example, a pressurized and/or chemical gas supply system, a physical and/or chemical air cleaning system, a humidity control system, and the like. As shown in FIG. 13, a gas supply system 1330 may provide air and/or oxygen to the interior of the safety chamber via ports 1332.

In order to extend the period of time in which occupants can survive in the safety chamber, the systems may employ a pure oxygen supply, along with carbon dioxide removal. By using high-pressure oxygen cylinders with automatic valves and oxygen sensors, an appropriate level of $O_2$ may be maintained in the shelter. For example, an oxygen sensor can be used to stop an otherwise constant flow of $O_2$ into a small living environment, thereby preventing the introduction of excessive $O_2$ into the environment. The safety chamber may also have a $CO_2$ removal system, sometimes called a "scrubber", to compensate for $CO_2$ exhaled by the occupants. For example, a $CO_2$ scrubber that uses a disposable granular $CO_2$ absorbent may be used to effectively remove accumulated $CO_2$ from the environment in the safety chamber. Occupants can change out the absorbent as it becomes saturated and replace it with fresh absorbent. The safety chamber may also be equipped with other types of physical and chemical scrubbers known to those in the art for removing harmful particulate matter or gases. Should the levels of contaminants reach dangerous levels despite the various scrubber systems, the safety chamber may also be provided with a purge system to replace the interior atmosphere with a compressed air source.

As depicted in FIG. 13, embodiments of the shelter may also include an atmospheric venting and/or purge system, and a control system that operates the atmospheric venting/purge system to selectively force an atmospheric gas from within the shelter to an outside of the shelter. The atmospheric venting/purge system may include one or more one-way vents 1310. The vent 1310 includes a venturi 1312 and a flapper valve (not shown). Thus, the vent 1310 is configured to open from the interior side of the vent at a first pressure, which can be set by adjusting the strength of the flapper valve. The vent 1310 is mechanically braced to resist an air flow from the exterior of the shelter up to the operational pressure range of the flapper valve itself. For example, the vent may open when an interior pressure differential of approximately +1 PSI is applied to the interior of the vent, and resist exterior pressures of several atmospheres or more. The atmospheric venting/purge system may include a pressure assist device with a switch 1320 to generate a positive pressure differential against the interior of the valve 1310. The valve 1310 may include an exhaust fan to generate the additional pressure, or an air system 1330 can provide additional gas to the room via ports 1332. When used in an entry chamber, the purge system can be advantageously used to avoid harmful particulate matter and/or gas from entering the living area of the shelter when an occupant enters or exits the safety chamber. For example, an occupant may exit the entry chamber, which is sealed from the living area, to the exterior of the shelter. The potentially harmful atmosphere in the entry chamber can be immediately purged, or maintained until the occupant reenters the entry chamber. When the occupant reenters the entry chamber and closes the exterior door, the atmosphere in the entry chamber can be purged before the occupant enters the living area of the shelter. This can be particularly beneficial when the entry chamber is small compared to the living area by minimizing the amount of gas that is needed to purge contamination from entering and exiting the shelter.

The pressure regulation system may include seals designed to resist significant pressure, for example up to 15 PSI, and greater. The interior of the shelter can be manually opened and air removed from the safety chamber by a series of air drive motors. The purge system may have a built in pressure regulator that reads exterior and interior pressure. The use of interior and exterior pressure sensors can be helpful in preventing a build up of interior pressure and allowing air movement by venting safely. For example, in order to safely vent air from the shelter, the user need only raise the interior pressure to a level slightly above the restraining force of the one-way vent. In those circumstances, the user can easily read the interior and exterior pressure sensors to calculate the necessary interior pressure for venting. In other certain circumstances, increasing the pressure in the safety chamber to a level where venting can be accomplished may not be desirable due to the high pressure outside of the safety chamber. In such circumstances, the amount of gas necessary to achieve the required pressure may be so significant that the period for maintaining a breathable atmosphere may be greatly reduced. Accordingly, an exterior pressure reading may be used in making potentially life-saving decisions.

Figure 14:
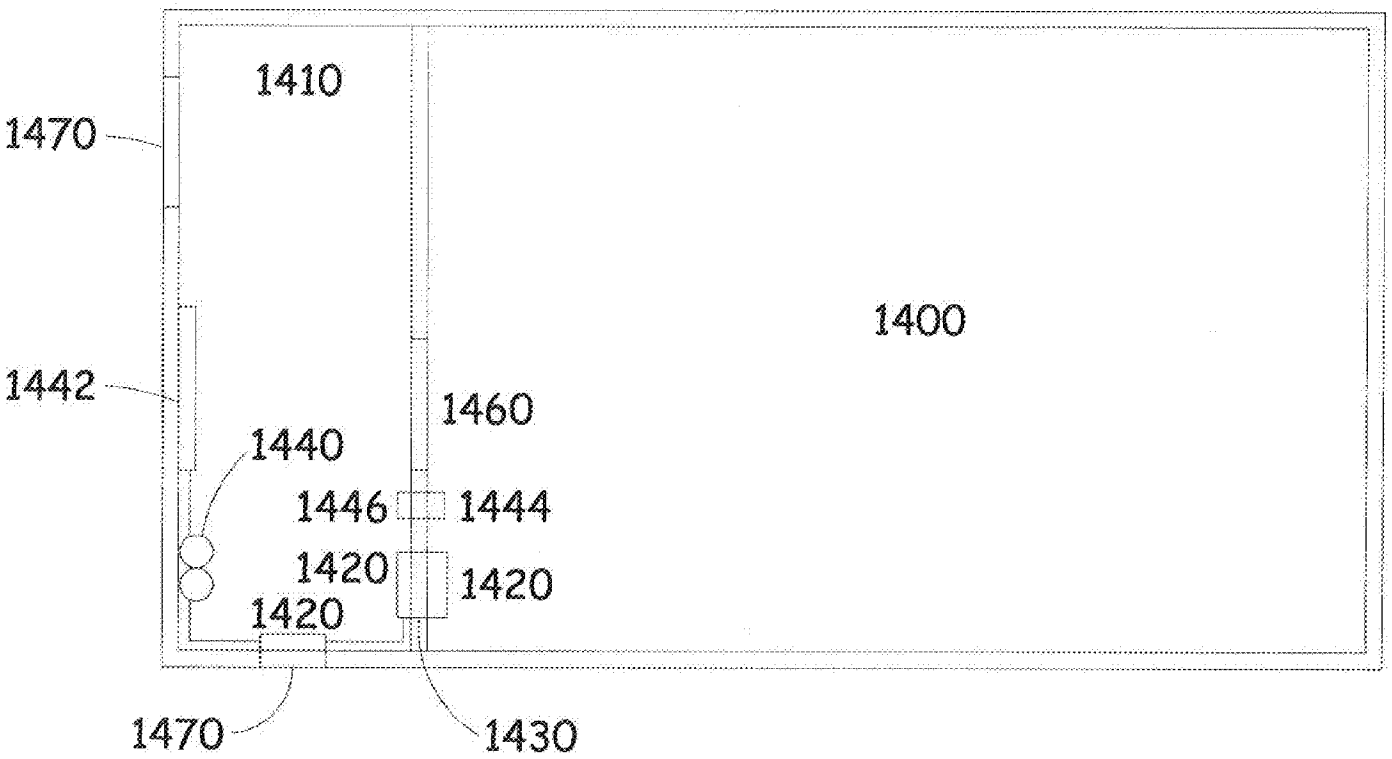
FIG. 14 depicts an exemplary floorplan and environmental system, in accordance with embodiments of the invention.

As depicted in FIG. 14, embodiments may also include the shelter being configured with an atmospheric exchange system and a control system that operates the atmospheric exchange system, to selectively transmit an atmospheric gas from one area of the shelter to an other area of the shelter. For example, a user in area 1400 may control an exchange of air between areas 1400 and 1410. Area 1400 may be a living area with an interior door 1460 leading to entry chamber 1410. Entry chamber 1410 may have an exterior door 1470, compressed air tanks 1440, and air ports 1442. By controlling fans 1420 in the walls between areas 1400 and 1410, the user may induce a flow of atmospheric gas between the chambers through valve(s) 1430. The valves may be one way valves, or valves that limit the flow of gas in both directions up to a specified pressure. In addition, a user may operate a gas supply system including tanks 1440 and ports 1442 to increase an amount of available gas or pressure in a particular area in order to induce or assist the flow. The gas supply system and fans may be operated by both of control panels 1444 and 1446 in the living area 1400 and entry chamber 1410, respectively. Thus, activities such as purging, air exchange and pressure equalization, etc. may be performed from either of areas 1400 and 1410.

In embodiments, the fans 1420 may be powered by a pressurized gas, which can be advantageous for a number of reasons. For example, compressed air can be a ready power source when the shelter includes a significant amount of pressurized air. The air drive motors do not require oil and they allow the "exhaust" to be breathed without harm. Additionally, air power does not require fuels or potentially dangerous batteries to be introduced into the shelter, or stored outside of the shelter.

By way of further example, high-speed air driven micromotors may be used for the purpose of moving air from one chamber to another. These small air driven motors can be run by a series of quarter inch standard tubing down to a standard regulator. The regulator can tap off the operating pressure of the system at, for example, approximately 100 PSI. An 80-100 PSI available air supply from a compressed breathable air cylinder can be used to effectively drive two micro motors. A pair of 80 cubic foot scuba tanks can be used in the shelter to drive such motors for a prolonged period of time. More specialized high-pressure tanks can be used to extend the operation life of the motors.

To deal with situations where an undesirable pressure develops in one chamber, for example in a chamber on a side of a one way valve that does not allow a flow from the side of the chamber, or when the fans are not sufficient to overcome a pressure differential, the pressure regulating system may include a manual control to allow the valve to be opened or closed manually. Thus, one area, e.g. a living area 1400, may be allowed to normally regulate the pressure in that area in one direction, from the area 1400 side of the vent to the other 1410 side, as a pressure release mechanism to minimize the potential of an overage of pressure. However, if the user desires to equalize or compensate for a higher pressure on the 1410 side of the one-way valve, the user may open the valve manually.

With further reference to FIG. 14, a two stage exhaust function can be performed manually by activating either of controls 1444 and 1446. A first stage exhaust button may be linked to a pneumatically controlled valve that will remove air from the entry chamber via one-way valve 1470. A user can confirm whether the exhaust/purge has been successful by referring to atmospheric sensors and monitors discussed herein. In the event that pressing the first stage exhaust button does not remove enough air to allow the sensors to show that the chamber has been sufficiently purged, pressing a second stage exhaust button, which may be pushing the first stage exhaust button in further, will allow a flow of breathable air to exit from ports 1442 for the purpose of allowing air flow in, to the chamber and air flow out valve 1470.

Controls 1444, 1446 may also include an air save button which would allow a user to minimize an amount of air and pressure in entry chamber 1410 before exit. An air save function may actuate a fan 1420 between the entry chamber 1410 and the living chamber 1400 to pull as much air as possible back into the living area 1410 for the purpose of saving breathable air in the living chamber 1410 during entrances and exits.

Figure 15:
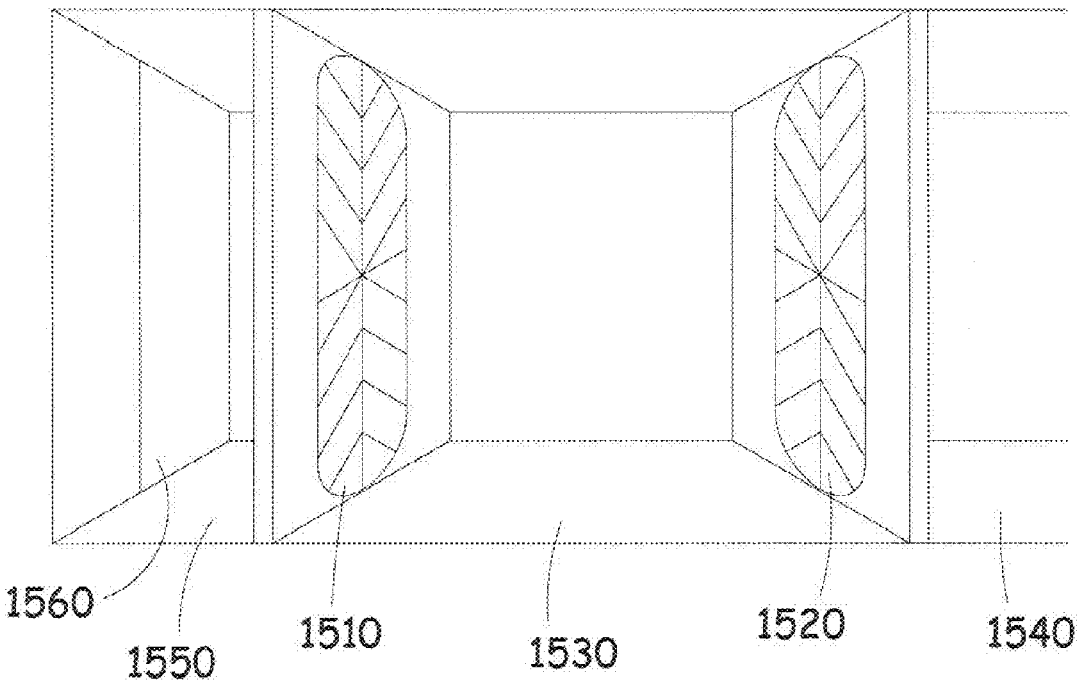
FIG. 15 depicts an exemplary soft seal door configuration, in accordance with embodiments of the invention.
Figure 16B:
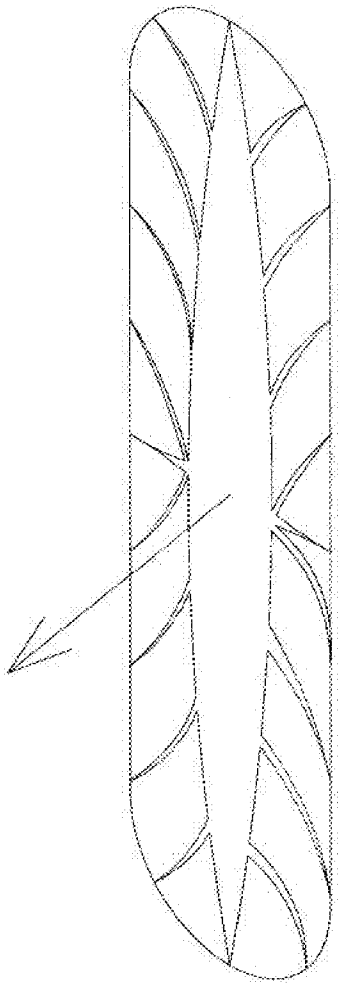
FIG. 16 depicts an exemplary soft seal door, in accordance with embodiments of the invention.
Figure 16A:
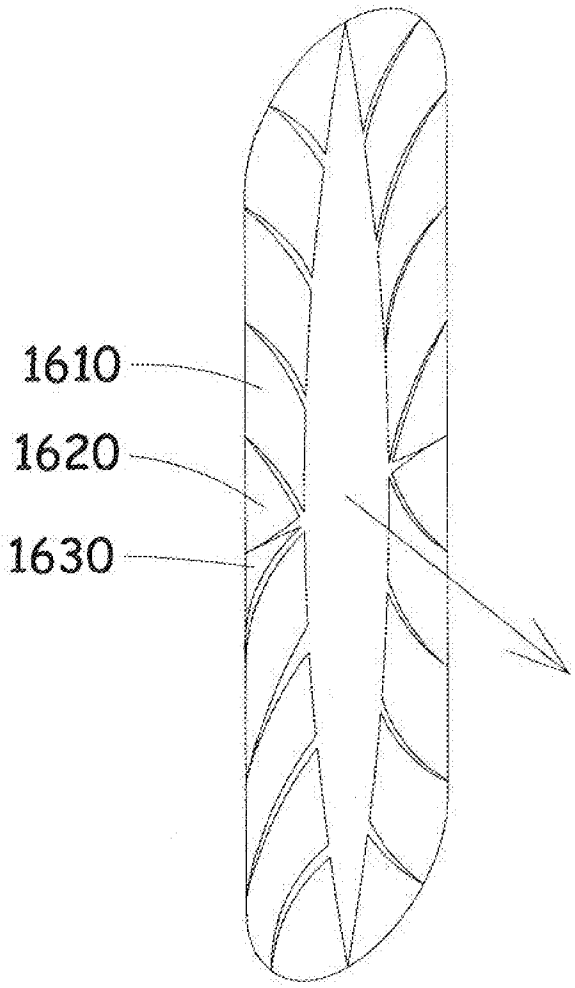

There is often a need in various environments to prevent gas, dust and other particulate matter from being carried from one area to another or to be minimized for the movement of individuals or items from one area to another. Aspects of the underground safety chamber are designed so that individuals can enter or exit, and move within the safety chamber, without contamination. For example, an air lock may be provided to cleanse the air being brought into the living chamber area of the unit. Additionally, a slight positive pressure may be maintained in the living chamber to allow occupants to move between the chambers without contamination. The present subject matter includes a "soft seal" door system that may also allow improved movement between areas of a shelter, and allow activities, such as a person carrying loads, without the manual opening typically required for a sealed door. As shown in FIG. 15, a soft seal door 1510 may be made up of a series of cut pieces of flexible material, such as high density foam. The pieces of flexible material may allow a person or item to pass through the doorway with a minimal opening caused by the separate pieces of material forming to the cross-section of the person/item passing through the doorway. As shown in FIGS. 16A-16B, a wiping action may also be created by the flexible material sliding across the person/item moving through the doorway. Thus, embodiments may include the soft seal door being configured to maintain at least partial contact with the body of a user while the user passes through the soft seal door. These features alone or in combination may be used to assist in maintaining a pressure differential between chambers when the door(s) are in a closed condition, and to minimize the movement of air or particulate matter from one side of the doorway to the other as the person/item passes through the doorway.

Referring back to FIG. 15, embodiments of the shelter may include an entry chamber 1550 that includes an exterior door 1560, an antechamber 1530, and a living area 1540. Soft seal doors 1510 and 1520 may connect the entry chamber 1550 to antechamber 1530 and antechamber 1530 to living area 1540, respectively. Although the particular embodiment shown in FIG. 15 is described and depicted with an antechamber 1530, other embodiments without such an antechamber are also contemplated. For example, the entry chamber 1550 may be attached to a living chamber 1540 directly or via an antechamber 1530. In embodiments, the shelter may be configured to maintain the living chamber 1540 at a higher pressure than a pressure of the entry chamber 1550 and/or the antechamber 1530. The soft seal door(s) 1510, 1520 may be configured to assist in maintaining the higher pressure in the living area 1540.

FIG. 15 shows an antechamber 1530 between two chambers 1540, 1550 in which it may be required that there be a minimal movement of air, dust, particulate matter, or other undesirable matter. As a means of accomplishing this, the two soft seal doors 1510, 1520 include a plurality of divisions, including vertical, horizontal and diagonal divisions, in the flexible material. The material may include multiple layers of material, such as a durable high durometer foam material. A foam, or other flexible, material may be sliced, or otherwise separated, in such a way that the memory of the material permits elastic deformation when a person or object moves through from one side to the door to the other, while only a reduced amount of air or particulate matter to be transferred, compared to an open doorway. In FIG. 16, a person is shown first preparing to enter the soft seal door by pushing a leg and an arm through the seal as in FIG. 16A. FIG. 16B further shows how a person may move through the soft seal door in the opposite fashion. The cuts in the soft seal door, including vertical, horizontal and diagonal divisions, are designed in such a way to promote a wiping effect, as shown in FIG. 16B, maintain a relatively contoured opening with the person/item moving through the door, and allow a person/item to pass forward or backward through the door with a reduced amount of movement of air, dust, or particulate matter. As mentioned above, individual slats 1610, 1620, 1630 act as wipers and hold closely to the person/item passing through to reduce contamination between the two chambers.

Figure 17A:
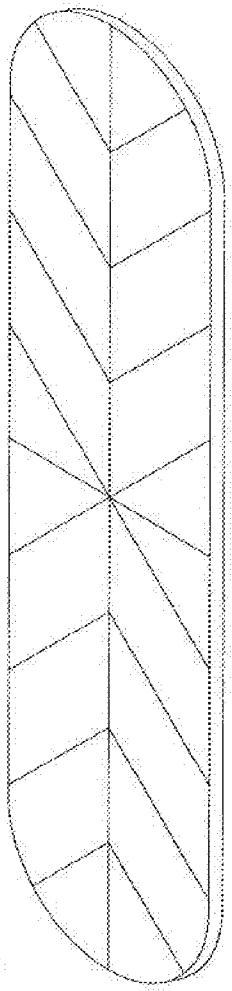
FIGS. 17A-17C depict aspects of an exemplary soft seal door, in accordance with embodiments of the invention.
Figure 17B:
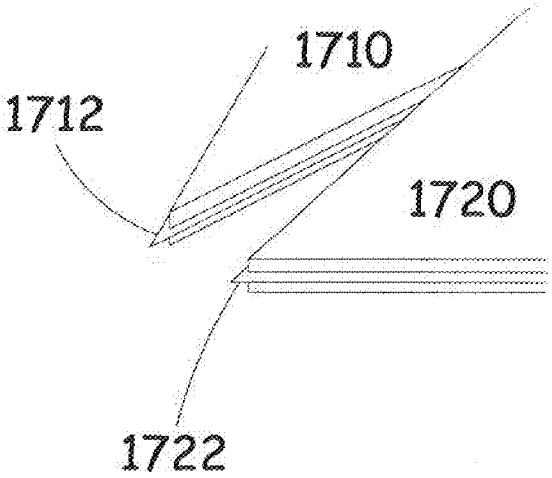
Figure 17C:
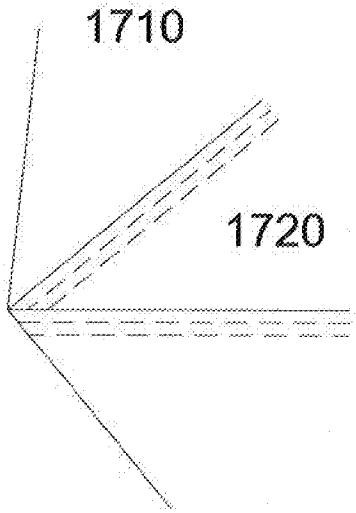

As shown in FIGS. 17A-17C, edges of the material can be shaped to increase the sealing properties of the soft seal door. For example, slats 1710, 1720 may be cut or formed with mating surfaces 1712, 1722, respectively, shown in FIG. 17B that overlap and/or interlock with each other in a closed configuration as shown in FIG. 17C.

Figure 18:
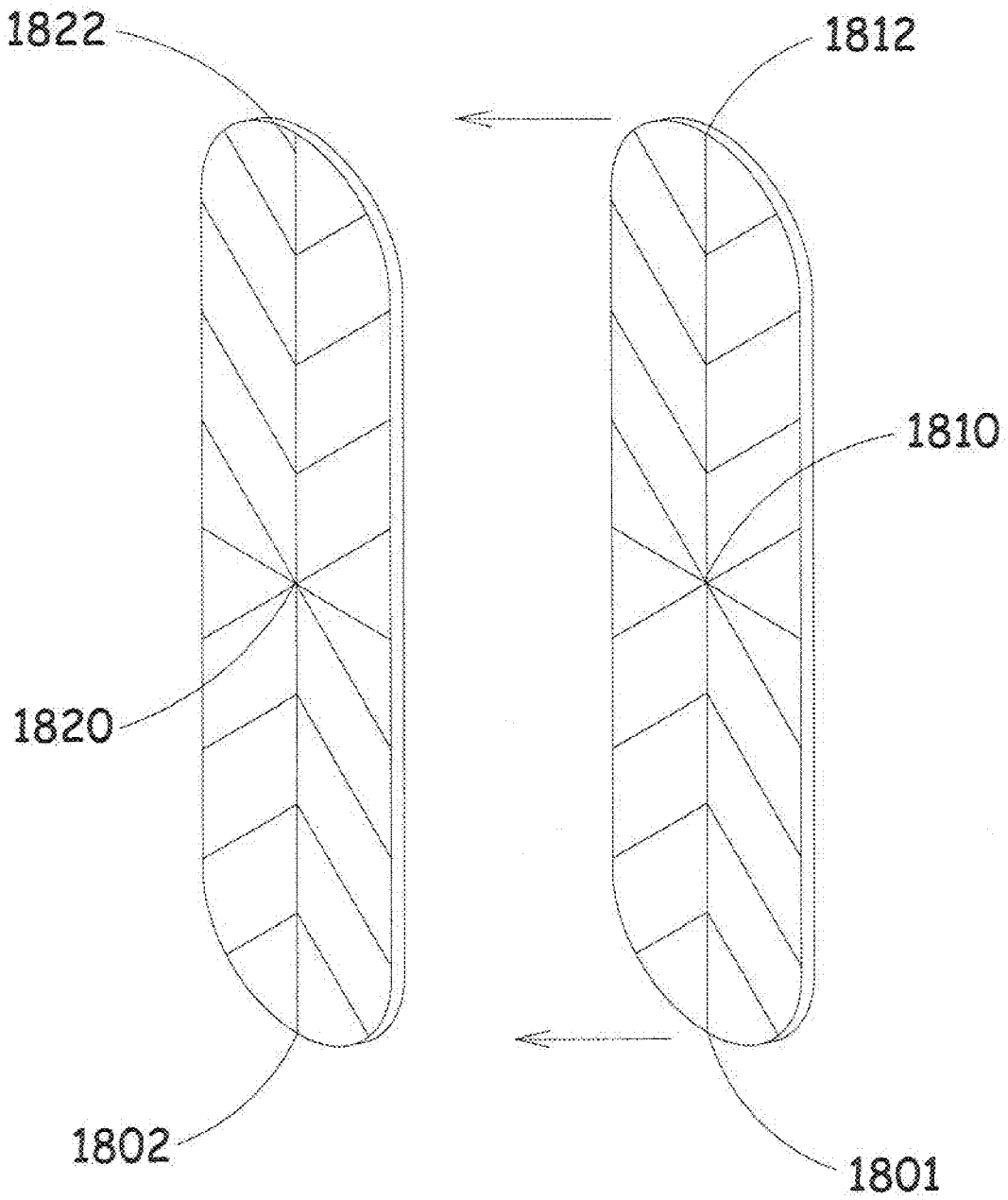
FIG. 18 depicts an exemplary soft seal door, in accordance with embodiments of the invention.

FIG. 18 depicts an embodiment of the soft seal door including a plurality, in this case two, layers of flexible material. Such a configuration may be used to improve the ability of the soft seal door to reduce contamination and airflow between chambers. When using multiple layers of material, wiping action may be improved and closer conformity to the person/item passing through the door may also be achieved. Additionally, when multiple layers are used, two or more of the layers may have non-coincident nexuses and/or central vertical or horizontal axes. As shown in FIG. 18, a first layer of material 1801 may have a cut nexus 1810 that is non-coincident with a cut nexus 1820 of material layer 1802. Additionally, first layer of material 1801 may have a vertical cut axis 1812 that is not aligned with vertical cut axis 1822 of material layer 1802. Such placements may allow a person/item to move through the doorway at a slight angle and increase a number of slats closely holding onto the body, and reduce transfer of unwanted material between chambers.

Figure 19:
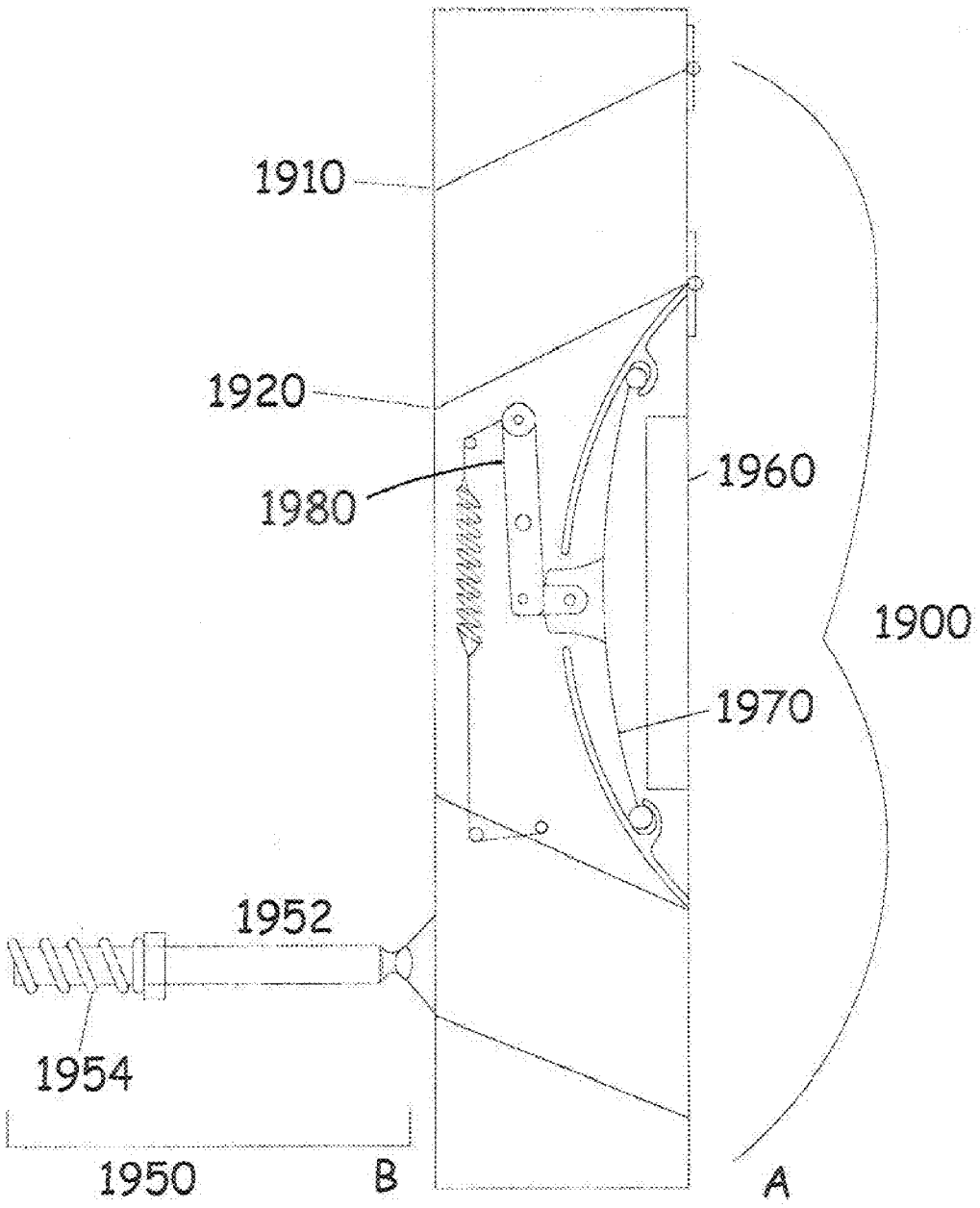
FIG. 19 depicts an exemplary exterior vent, in accordance with embodiments of the invention.
Figure 20:
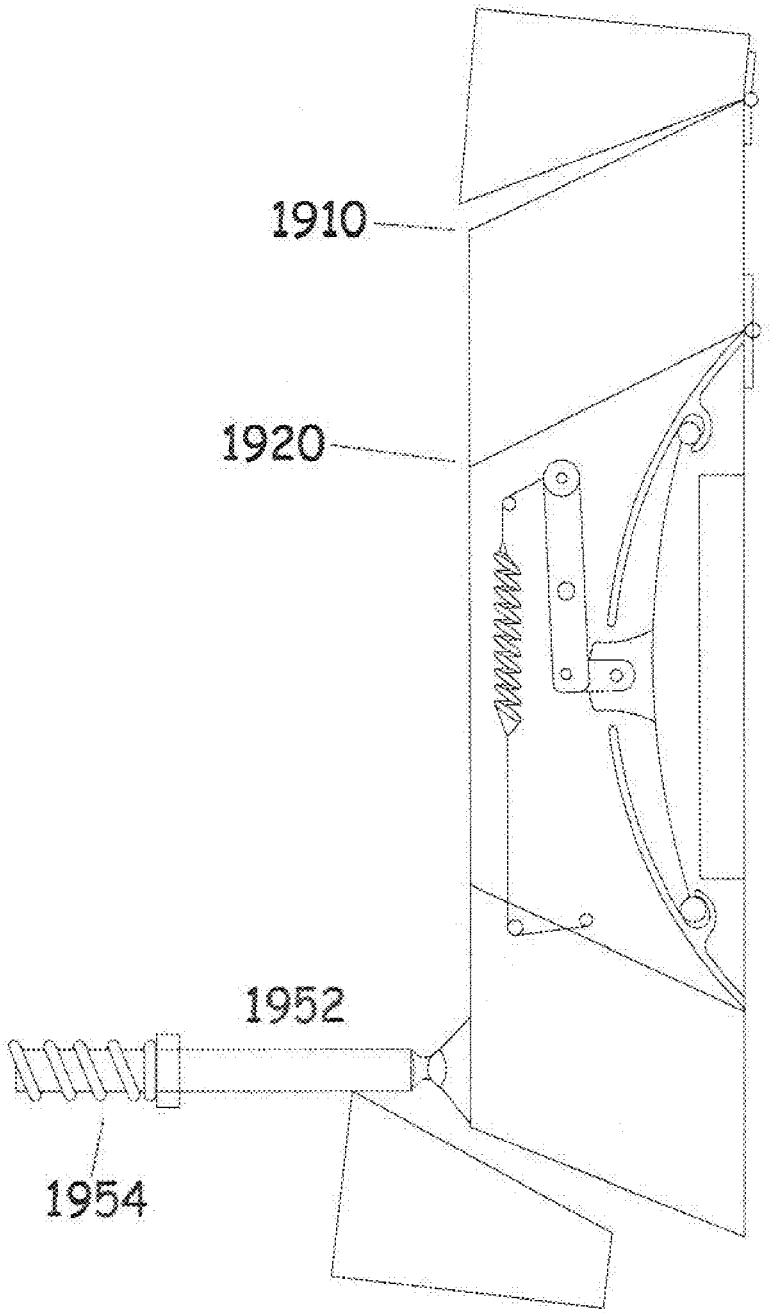
FIG. 20 depicts an exemplary exterior vent, in accordance with embodiments of the invention.
Figure 21:
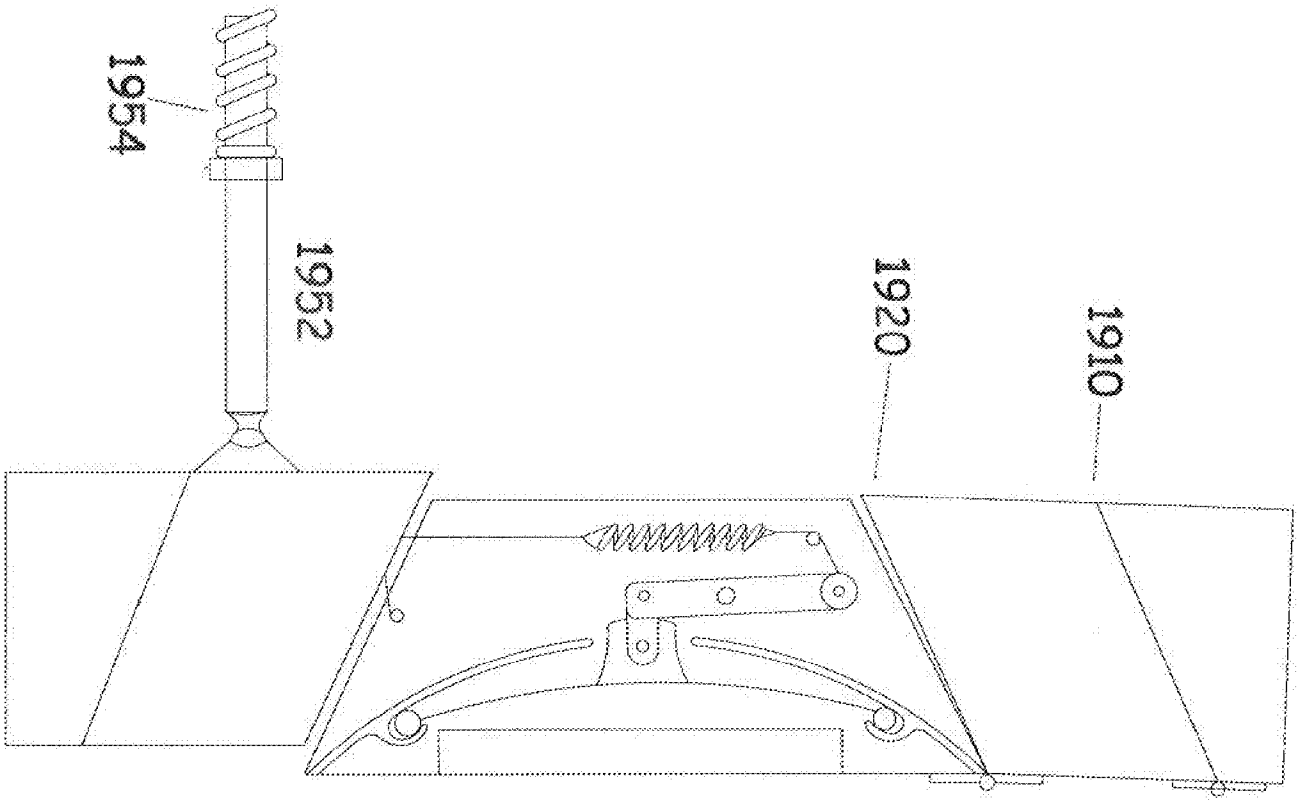
FIG. 21 depicts an exemplary exterior vent, in accordance with embodiments of the invention.

Embodiments of the shelter may also include an exterior vent, such as depicted in FIGS. 19-21. Exemplary exterior vent 1900 is depicted as including a first seal 1910 and a second seal 1920. As shown, first seal 1910 and second seal 1920 may be configured as conical seals that mechanically resist a pressure from side A to side B. The second seal 1920 may be configured to automatically open in response to a positive air pressure differential on an interior surface of the exterior vent, depicted as side B in FIG. 19. This may be set at a relatively high level, for example approximately a +15 PSI air pressure differential on the interior surface of the exterior vent or at a lower level down to approximately +1 PSI. Embodiments may also include an opening mechanism, e.g. 1950, that is configured to manually open the first seal 1910 from inside the shelter. The opening mechanism 1950 may include a piston 1952 and an assist mechanism 1954 that may be configured to assist in overcoming a positive pressure differential on an exterior surface of the exterior vent 1900, such as, for example approximately a +15 PSI air pressure on the exterior surface B of the exterior vent 1900. An example of the first seal 1910 in an open position is shown in FIG. 20.

With further reference to FIG. 19, a grill 1960 may allow air pressure from side B to contact a rubber diaphragm unit 1970 which transmits a linear force, according to the pressure, back through a linkage 1980. Linkage 1980 may expand arms being pressed forward and act as a locking/unlocking mechanism. FIG. 21 shows the unit opened along second seal 1920 to allow pressure to escape from side A to side B of the unit. FIG. 21 shows the second seal mechanism relaxed by the positive pressure differential on side A.

As depicted in FIGS. 22A-22D, embodiments may include features that allow the shelter to be connected to a borehole from the surface, such as a borehole used for resupplying air, water and other necessities. The features may also allow for connection to a variety of electronic applications for power, communications, and the like. As shown in FIG. 22A, the shelter 2200 may include a mating device 2210 configured to connect to an external supply hose 2220. The external supply hose 2220 may be used to supply the shelter with a gas and/or a liquid from outside of the shelter. The mating device may include an airflow control valve 2230 shown in FIG. 22C and/or a first mating surface 2240 configured to connect to supply hose or pipe 2220. The mating surface may include threaded screws, snap-on connectors and the like. The supply hose 2220 may be a relatively large diameter hose, for example a hose having a diameter of approximately of several inches or greater, such as those used in rescue and firefighting applications, and the like. In embodiments, the shelter 2200 includes the supply hose 2220 configured for use with the first mating surface 2240, as shown in FIG. 22D. As discussed further below, providing the shelter with such a pre-configured supply hose may be advantageous in simplifying rescue operations, which can bore into an underground cavity where the shelter is located. By way of further example, a 4 inch windable hose with semi rigid walls has been found effective in allowing airflow and the like to the shelter, and for easy coupling to a rescue borehole or pipe.

The supply hose 2220 is depicted with a second mating surface 2242 on a first end of the supply hose 2220. The second mating surface 2242 is shown as configured to attach to the first mating surface 2240 of the mating device 2210. The particular configurations of the mating surfaces is not limiting and are provided for example only.

Figure 23A:
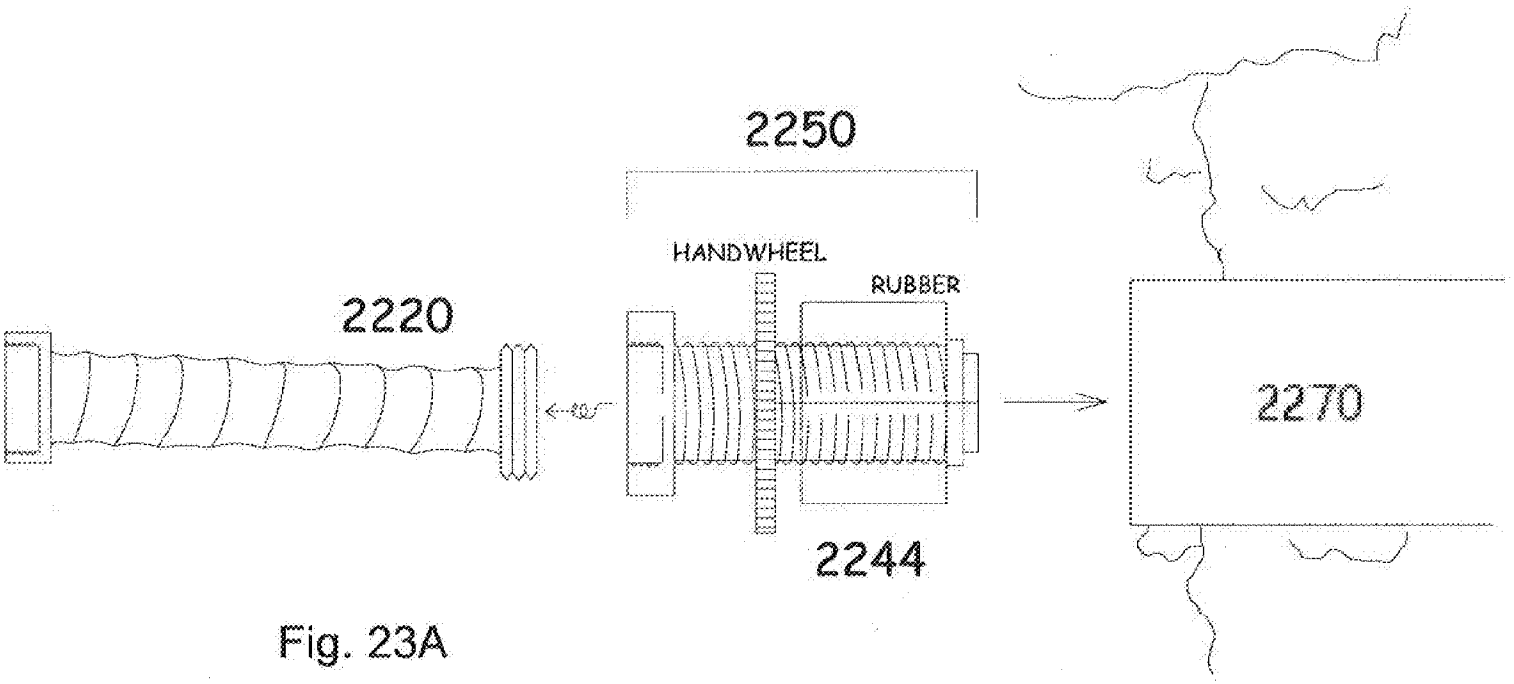
FIGS. 23A-23B depict aspects of an exemplary supply hose and adjustable mating surface, in accordance with embodiments of the invention.
Figure 23B:
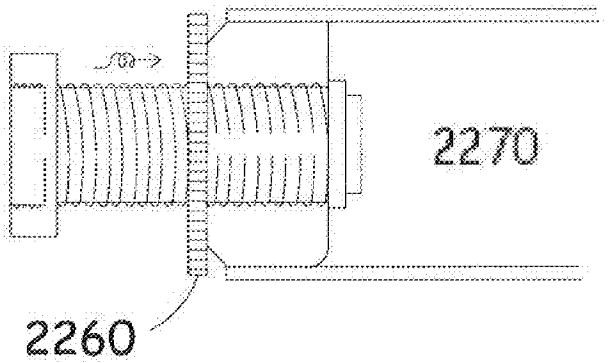

As shown in FIG. 23A the supply hose 2220 may also include an adjustable mating surface 2244 at a second end of the supply hose 2220. The adjustable mating surface 2244 may be included in a removable part 2250, or may be formed integrally with the supply hose 2220. The adjustable mating surface 2244 may be adjustable to a range of diameters, such as by reducing and expanding the diameter of the mating surface, which may include a flexible material. By way of example, the adjustable mating surface 2244 may be adjusted via a turning mechanism 2260 on the second end of the supply hose or the removable piece 2250. As shown in FIG. 23B turning a hand wheel 2260 can cause an increase in the diameter of the second mating surface 2244 and allow the supply hose or removable part to be securely fastened in a bore hole 2270.

Thus, a borehole connector/mating device may allow a shelter used in mining or other underground industries to be conveniently connected to a hole that has been drilled down through the earth for the purpose of connecting air supply, communication signals, or other items to be communicated through the hole/pipe. As discussed herein, the borehole connector/mating device may be configured such that a stored flexible piece of tubing, supply hose, can be quickly connected to the safety chamber of the shelter. The opposite end of the supply hose can be connected to a wide variety of diameters of piping used in the drilling industry that would allow the open area of the borehole to be connected from the surface, possibly connecting surface air circulating systems, to the safety chamber below the earth.

According to embodiments, the borehole connector/mating device may be configured such that an occupant could exit the shelter, go to a borehole with the supply hose, or with a removable part including an adjustable mating surface, secure the supply hose in the borehole, secure the other end of the supply hose to the shelter, and allow breathable air to be blown under pressure into the safety chamber of the shelter. Embodiments also include an adjustable valve as part of valve 2230 that may allow for reduction of air flow into the safety chamber. Such features may be advantageous in circumstances where an amount of air being pumped from the surface is excessive and could over-pressurize the interior of the safety chamber.

Embodiments may also include systems designed to provide water, food, and basic utilities, which are designed for bodily functions, and human needs. As discussed above, wall units of the shelter are modularly designed and may include removable storage spaces which may contain a wide variety of devices that are required for the sustaining of life after a disastrous event in a mine situation. The safety chamber may be air-conditioned and/or provided with thermal equipment. The safety chamber may also include a dehumidification device, and be set up to self-maintain with periodic inspections and controls.

According to aspects of the invention, an underground shelter may be designed to be set in position, ready for activation for an extended period of time. Compressed gases may be stored in cylinder form, and batteries stored, charged and prepared for efficiency of activation when needed. Thus, after placement, the shelter may be maintained in a prepared condition by checking compressed gas levels and battery charge, which are relatively simple maintenance activities. The modular shelter may be designed to be transportable, and the modular design can allow for ease of repair in the event of damage to the unit.

Embodiments may include a modular shelter kit with parts to assemble a modular shelter as described herein without limitation. For example, a modular shelter kit may include a plurality of wall units, a base unit and/or a roll cage as described above and according to the claims as filed. Kits may also include additional parts as described herein such as, for example, interior brackets that are configured to join the wall units together along seams, a sealant that may assist in forming seals along edges and corners of connected wall units, modular base pieces, edge pieces or other pieces that are shaped differently than the plurality of base pieces, and other parts used to configure the shelter to maintain a pressurized state in a closed condition.

Embodiments of the modular shelter kit may also include an atmospheric venting and/or purge system, a control system that operates the atmospheric venting/purge system, one or more one-way vents, a pressure assist device, means for cleaning, supplementing, and/or otherwise modifying an interior atmosphere of the assembled shelter, an atmospheric system, an atmospheric exchange system, air movement subsystems, and/or fans that operate on a pressurized gas, as described above and according to the claims as filed.

Embodiments of the modular shelter kit may also include an exterior door for the assembled shelter, means for maintains the living chamber at a higher pressure than a pressure of the entry chamber, and/or a soft seal door, as described above and according to the claims as filed.

Embodiments of the modular shelter kit may also include a mating device configured to connect to an external supply hose, an airflow control valve, a large diameter hose configured for use with the mating device, an adjustable mating surface adjustable to a range of diameters, as described above and according to the claims as filed.

Embodiments include a method of assembling a modular shelter such as those modular shelters and modular shelter kits discussed herein. Embodiments may include assembling a base unit that extends substantially throughout a floor plan of the assembled modular shelter. The base unit may be assembled from a group of pieces including a plurality of modular base pieces, each of the modular base pieces sharing a substantially common shape and substantially common dimensions. The base unit assembly may also include edge pieces or other pieces that are shaped differently than the plurality of base pieces.

Embodiments may include assembling at least two wall units to form a substantially air-tight seal along a seam between the at least two wall units. For example, as shown in FIG. 9, a plurality of wall units 920-928 may be assembled to form walls, ceiling, and floor of a shelter. Each of wall units 920-928 may share a substantially common shape and substantially common dimensions.

Embodiments may include attaching a roll cage to at least one of the wall unit assembly and the base unit. For example, as shown in FIG. 6, a roll cage 610 may be assembled to a base unit 620. This may be done before or after assembly of a safety chamber within the outer limits of the roll cage. The roll cage 610 may surround an outer extent of the modular shelter above the floor plan, substantially represented by the floor plan of base unit 620. Embodiments may include sealing the modular shelter such that the assembled modular shelter maintains a pressurized state in a closed condition. For example, the shelter may be sealed along seams such as 950 in FIG. 9, to selectively withstand a pressure differential in a range of approximately ±15 PSI between an interior of the shelter and an exterior of the shelter. In embodiments, the shelter may be sealed to withstand a greater exterior pressure differential than an interior pressure differential. For example, the shelter may withstand an exterior pressure differential of approximately +15 PSI, or more, and allow venting of an interior pressure of approximately +1 PSI through one-way vents described above or other mechanisms known to those of skill in the art.

Embodiments may include lifting, sliding, and/or pushing the assembled modular shelter to an operating position in an underground environment via a boom/hard point on the roll cage and/or the base unit. The assembled modular shelter may be in a substantially operational condition when moved into position. For example, the unit may have all necessary assembly completed when moved, except for the provisioning of replenishables and non-structural parts.

The invention has been described with reference to exemplary embodiments. Modifications and alterations of the described embodiments may be evident to those of ordinary skill in the art upon a reading and understanding of this specification. The present invention is intended to include all such modifications and alterations insofar as they come within the scope of the appended claims, or the equivalents thereof.

What is claimed is:

1. A modular shelter, comprising:

at least two wall units;

a base unit that extends substantially throughout a floor plan of the shelter;

an entry chamber including an exterior door; and a living chamber attached to the entry chamber;

wherein the shelter is configured to maintain a pressurized state in a closed condition and to maintain the living chamber at a higher pressure than a pressure of the entry chamber, and wherein adjacent wall units of the shelter are connected along a substantially sealed seam and held together along said seam by one or more U- or L-brackets.

2. The shelter of claim 1, wherein a sealing material is included in said seam.

3. The shelter of claim 1, further comprising:

an atmospheric purge system; and a control system that operates the atmospheric purge system to selectively force an atmospheric gas from within the shelter to an outside of the shelter.

4. The shelter of claim 1, further comprising a mating device configured to connect to an external supply for supplying at least one of a gas and a liquid.

5. The shelter of claim 4, wherein:

the mating device comprises:

an airflow control valve; and a first mating surface configured to connect to a supply hose; and wherein the shelter further comprises the supply hose, the supply hose comprising: a second mating surface on a first end of the supply hose, the second mating surface configured to attach to the first mating surface of the mating device.

6. The shelter of claim 5, wherein the supply hose further comprises an adjustable mating surface at a second end of the supply hose, wherein the adjustable mating surface is adjustable to a range of diameters via a turning mechanism on the second end of the supply hose.

7. The shelter of claim 1, wherein the base unit comprises a plurality of modular base pieces, each of the modular base pieces sharing a substantially common shape and substantially common dimensions.

8. The shelter of claim 1, further comprising a roll cage that surrounds an outer extent of the shelter above the floor plan.

9. The shelter of claim 8, wherein the base unit comprises a plurality of hard points on the corners of the base unit to assist in dragging the shelter on the ground.

10. The shelter of claim 1, further comprising:

a soft seal door between the entry chamber and the living chamber, the soft seal door comprising a flexible material with a plurality of slats or divisions and configured to assist in maintaining the higher pressure in the living area and maintain at least partial contact with a user while the user passes through the soft seal door.

11. The shelter of claim 10, wherein the soft seal door comprises a flexible material that is cut into a plurality of slats or divisions, the slats or divisions having mating surfaces that overlap or interlock when the soft seal door is in a closed position.

12. The shelter of claim 1, wherein each of the at least two wall units share a substantially common shape and substantially common dimensions.

13. The shelter of claim 1, wherein the shelter is reconfigurable to a different size or shape by adding or removing one or more wall units.

14. The shelter of claim 1, wherein each of the at least two wall units has folded edges along the perimeter of each wall unit.

15. The shelter of claim 14, wherein the at least two wall units form part of a wall or ceiling of the shelter, and wherein the folded edges of adjacent wall units of the wall or ceiling of the shelter are clamped together by a U-bracket from the one or more U- or L-brackets.

16. The shelter of claim 15, wherein the U-bracket is secured to the adjacent wall units by an additional fastener.

17. The shelter of claim 14, wherein adjacent wall units of the at least two wall units form part of a wall and part of a ceiling of the shelter, and wherein the folded edges of the adjacent wall units are held together by an L-bracket from the one or more U- or L-brackets.

18. The shelter of claim 1, wherein the modular shelter includes at least four wall units, the at least four wall units being connected and arranged in a plurality of columns and a plurality of rows to form at least part of a wall or ceiling of the shelter.

19. The shelter of claim 18, wherein the wall units of the wall or ceiling of the shelter are arranged in at least two rows and at least four columns.

20. The shelter of claim 18, wherein each of the at least four wall units has folded edges along the perimeter of each wall unit, and wherein the folded edges of adjacent wall units of the wall or ceiling of the shelter are clamped together by a U-bracket from the one or more U- or L-brackets.

21. The shelter of claim 1, the shelter comprising at least two walls and a ceiling that enclose the shelter, wherein each of the two walls comprise at least two wall units joined and held together by one or more threaded fasteners.

22. A modular shelter, comprising:

at least two wall units connected along a substantially sealed seam;

a base unit that extends substantially throughout a floor plan of the shelter;

an exterior door, the exterior door comprising:

a first seal; and a second seal; and an opening mechanism that is configured to manually open the first seal, wherein the shelter is configured to maintain a pressurized state in a closed condition, and wherein the second seal is configured to automatically open in response to a positive air pressure differential on an interior surface of the exterior door.

23. The shelter of claim 22, wherein a sealing material is included in said seam.

24. The shelter of claim 22, further comprising:

an atmospheric purge system; and a control system that operates the atmospheric purge system to selectively force an atmospheric gas from within the shelter to an outside of the shelter.

25. The shelter of claim 22, wherein the base unit comprises a plurality of modular base pieces, each of the modular base pieces sharing a substantially common shape and substantially common dimensions.

26. The shelter of claim 22, further comprising a roll cage that surrounds an outer extent of the shelter above the floor plan.

27. The shelter of claim 22, wherein each of the at least two wall units share a substantially common shape and substantially common dimensions.

28. The shelter of claim 22, wherein the shelter is reconfigurable to a different size or shape by adding or removing one or more wall units.

29. The shelter of claim 22, wherein each of the at least two wall units has folded edges along the perimeter of each wall unit.

30. The shelter of claim 22, wherein the modular shelter includes at least four wall units, the at least four wall units being connected and arranged in a plurality of columns and a plurality of rows to form at least part of a wall or ceiling of the shelter.

31. The shelter of claim 22, the shelter comprising at least two walls and a ceiling that enclose the shelter, wherein each of the two walls comprise at least two wall units joined and held together by one or more threaded fasteners.

32. A kit for assembling a modular shelter, comprising:

at least two wall units;

a base unit sized to extends substantially throughout a floor plan of the assembled shelter;

an exterior door, the exterior door comprising:

a first seal; and a second seal; and an opening mechanism that is configured to manually open the first seal, wherein the second seal is configured to automatically open in response to a positive air pressure differential on an interior surface of the exterior door; and one or more U- or L-brackets, wherein each of the at least two wall units are configured such that adjacent wall units can be joined and held together by the one or more U- or L-brackets to form at least part of a wall or ceiling of the assembled shelter with a substantially sealed seam formed between the adjacent wall units.

33. The kit of claim 32, further comprising:

an atmospheric purge system; and a control system that operates the atmospheric purge system to selectively force an atmospheric gas from within the assembled shelter to an outside of the assembled shelter.

34. The kit of claim 32, further comprising:

a mating device configured to connect to an external supply for supplying at least one of a gas and a liquid.

35. The kit of claim 34, further comprising:

wherein the mating device comprises: a first mating surface configured to connect to a supply hose; the supply hose comprising:

a second mating surface on a first end of the supply hose, the second mating surface configured to attach to the first mating surface of the mating device.

36. The kit of claim 32, further comprising:

a plurality of supports for assembling a roll cage that surrounds an outer extent of the assembled shelter above the floor plan.

37. The kit of claim 32, further comprising:

a soft seal door configured to assist in maintaining a pressure differential on opposite sides of the soft seal door when installed in the assembled shelter.

38. The kit of claim 37, wherein the soft seal door is configured to partially mold to the body of the user as the user transits through the soft seal door.

39. The kit of claim 32, further comprising: a roll cage.

40. A modular shelter, comprising:

at least two wall units;

a base unit that extends substantially throughout a floor plan of the shelter;

a supply hose; and a mating device configured to connect to an external supply for supplying at least one of a gas and a liquid, the mating device comprising:

an airflow control valve; and a first mating surface configured to connect to the supply hose;

the supply hose comprising:

a second mating surface on a first end of the supply hose, the second mating surface configured to attach to the first mating surface of the mating device; and an adjustable mating surface at a second end of the supply hose, wherein the adjustable mating surface is adjustable to a range of diameters via a turning mechanism on the second end of the supply hose;

wherein the shelter is configured to maintain a pressurized state in a closed condition, and wherein adjacent wall units of the shelter are connected along a substantially sealed seam and held together along said seam by one or more U- or L-brackets.

* * * * *